US006851976B2

(12) United States Patent
Ichida et al.

(10) Patent No.: US 6,851,976 B2
(45) Date of Patent: Feb. 8, 2005

(54) CONNECTOR, A TERMINAL FITTING AND A METHOD FOR INSERTING A TERMINAL FITTING

(75) Inventors: Kiyofumi Ichida, Yokkaichi (JP); Yukihiro Fukatsu, Yokkaichi (JP); Toshikazu Sakurai, Yokkaichi (JP); Shinya Fujita, Yokkaichi (JP); Yuuichi Nankou, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/271,682

(22) Filed: Oct. 15, 2002

(65) Prior Publication Data

US 2003/0228793 A1 Dec. 11, 2003

(30) Foreign Application Priority Data

Jun. 6, 2002 (JP) ..... 2002-166366
Jun. 24, 2002 (JP) ..... 2002-183588

(51) Int. Cl.[7] ..... H01R 13/40
(52) U.S. Cl. ..... 439/595
(58) Field of Search ..... 439/595, 752, 439/851, 852

(56) References Cited

U.S. PATENT DOCUMENTS 4,804,339 A * 2/1989 Cohen ..... 439/588
5,235,743 A 8/1993 Endo et al.
5,238,411 A * 8/1993 Jinno et al. ..... 439/59
5,626,499 A * 5/1997 Yagi et al. ..... 439/752.5
5,643,018 A * 7/1997 Sakai et al. ..... 439/852
5,664,326 A * 9/1997 Ohsumi ..... 29/874
5,860,835 A * 1/1999 Ohsumi ..... 439/595
5,879,205 A 3/1999 Egenolf et al.

FOREIGN PATENT DOCUMENTS

DE 43 12 641 A1 10/1994
EP 0 673 082 A1 9/1995
EP 0 732 771 A2 9/1996
EP 0 986 143 A1 3/2000

* cited by examiner

*Primary Examiner*—J. F. Duverne
(74) *Attorney, Agent, or Firm*—Gerald E. Hespos; Anthony J. Casella

(57) ABSTRACT

A connector has a housing (10) with a cavity (11) and a resiliently deformable lock (13) in the cavity (11). The connector further has a terminal fitting (30) that can be inserted into the cavity (11). The insertion of the terminal fitting (30) deforms the lock (13). However, the lock (13) restores when the terminal fitting (30) is inserted completely, and locks the terminal fitting in the cavity (11). The terminal fitting (30) and the cavity (11) are formed with mutually engageable structures (53, 26) for preventing inclination of the terminal fitting (30) in the deforming direction of the lock (13).

8 Claims, 32 Drawing Sheets

CONNECTOR, A TERMINAL FITTING AND A METHOD FOR INSERTING A TERMINAL FITTING

BACKGROUND OF THE INVENTION

1. Field of the Invention

The invention relates to a terminal fitting, a connector and to a method for inserting a terminal fitting into a cavity in a housing of a connector.

2. Description of the Related Art

U.S. Pat. No. 5,235,743 and FIG. 32 herein show a connector with a housing 1 that has a cavity 2 and a terminal fitting 3 inserted in the cavity 2. The cavity 2 has a bottom wall 4 that is cut to define a forwardly cantilevered lock 5 that locks the terminal fitting 3 in the cavity 2. A support 6 of the bottom wall 4 of the cavity 2 forward of the lock 5 supports the inserted terminal fitting 3 substantially horizontally.

The housing 1 is molded of a resin by molds that open and close along forward and backward directions. The support 6 is displaced from the lock 5 in widthwise direction as shown in FIG. 33 to remove the mold forward of the lock 5. The width "a" of the cavity 2 could be reduced to make a miniature connector. However, it is difficult to ensure sufficient widths "b", "c" for both the lock 5 and the support 6.

The present invention was developed in view of the above problem and an object thereof is to provide a connector suited to being miniaturized.

SUMMARY OF THE INVENTION

The invention relates to a connector with a housing that has opposite front and rear ends. At least one cavity extends through the housing from the rear end to the front end, and terminal fittings are inserted into the cavities from behind. A resiliently deformable lock is formed in the cavity and is configured to deform away from the cavity as the terminal fitting is inserted into the cavity. The lock is restored resiliently when the terminal fitting is inserted completely and locks the terminal fitting in the cavity. The terminal fitting comprises a supportable portion, and the cavity comprises a supporting portion for engaging and supporting the supportable portion in a manner that prevents inclination of the terminal fitting with respect to the lock.

The supporting portion and the lock preferably are spaced from one another along the deforming direction of the lock. Additionally, the housing may be molded by front and rear molds that are closed and opened along inserting and withdrawing directions of the terminal fitting. As a result, the width of the lock can be set independently of the supporting portion. Thus, even if the connector is miniaturized, a sufficient force to lock the terminal fitting can be ensured, and the terminal fitting can be supported firmly by the supporting portion. Therefore, the connector is well suited to being miniaturized.

The supporting portion may project inwardly at a front corner of the inner surface of the cavity, and the supportable portion may be recessed at a front corner of the terminal fitting so that the supporting portion can fit into the supportable portion. The engagement of the supporting portion in the supportable portion prevents the terminal fitting from inclining in the deforming direction of the lock.

The terminal fitting is substantially box-shaped, and a resilient contact piece is provided at one of the surrounding walls of the terminal fitting for resilient contact with a mating terminal. The supportable portion is not on the same wall as the resilient contact piece, and preferably is on a corner between the wall opposite the wall that has the resilient contact piece and a wall substantially normal thereto.

The terminal fitting may be cut partly away to form the supportable portion. However, the recessed supportable portion does not expose the resilient contact piece to the outside because the supportable portion and the resilient contact piece are formed at opposite sides. Thus, external matter will not interfere with the resilient contact piece.

The supporting portion may comprise a recess on the inner surface of the cavity, and the supportable portion may project from the terminal fitting for engagement with the recessed supporting portion. Thus, the supportable portion that projects from the terminal fitting fits into the recessed supporting portion in the cavity when the terminal fitting is inserted into the cavity to prevent the terminal fitting from inclining in the deforming direction of the lock.

The supportable projection may be an embossment that is continuous with the sidewall over substantially the entire periphery of the supportable projection. The embossed supportable projection that is continuous with the sidewall contributes to the strength of the terminal fitting.

The supportable projection may be embossed in a sidewall of the terminal fitting so that sides of the supportable projection substantially normal to the deforming direction of the lock are separated from the sidewall. Cut end surfaces of the supportable projection are engageable with the supporting portion. Thus, the terminal fitting can be supported firmly to prevent inclination of the terminal fitting.

The sidewall of the terminal fitting that has the supportable portion may be embossed with a bead for reinforcing the terminal fitting. The bead ensures high strength for the terminal fitting even if the supportable portion is separated from the sidewall of the terminal fitting.

The reinforcing bead preferably is formed within a range of the supportable projection that extends along the deforming direction of the lock. Thus, the bead can enter the supporting portion when the terminal fitting is inserted into the cavity. Accordingly, no special groove is required for the bead, and the construction of the housing can be simplified.

The invention also is directed to a method for inserting a terminal fitting into a cavity in a housing of a connector. The method comprises providing a lock in the cavity and inserting the terminal fitting into the cavity for resiliently deforming the lock in a deformation direction that intersects inserting and withdrawing directions of the terminal fitting. The lock resiliently locks the terminal fitting upon proper insertion. Inclination of the terminal fitting with respect to the lock is prevented by engaging a supportable portion of the terminal fitting with a supporting portion of the cavity.

These and other objects and advantages of the invention will become more apparent based on the following description of preferred embodiments and accompanying drawings. Even though embodiments are described separately, single features may be combined to for other embodiments.

DETAILED DESCRIPTION OF THE PREFERRED EMBODIMENTS

A female connector in accordance with a first embodiment of the invention includes a female housing 10 with female terminal fittings 30 mounted therein, as shown in FIGS. 1 to 17. The female housing 10 is connectable with an unillustrated male housing so that the female terminal fittings 30 are electrically connectable with unillustrated male terminal fittings in the male housing. In the following description, directions of inserting and withdrawing the female terminal fittings 30 into and from the female housing 10 are referred to as a forward direction and a backward direction, respectively, and reference is made to FIG. 8 concerning the vertical direction.

Figure 1:
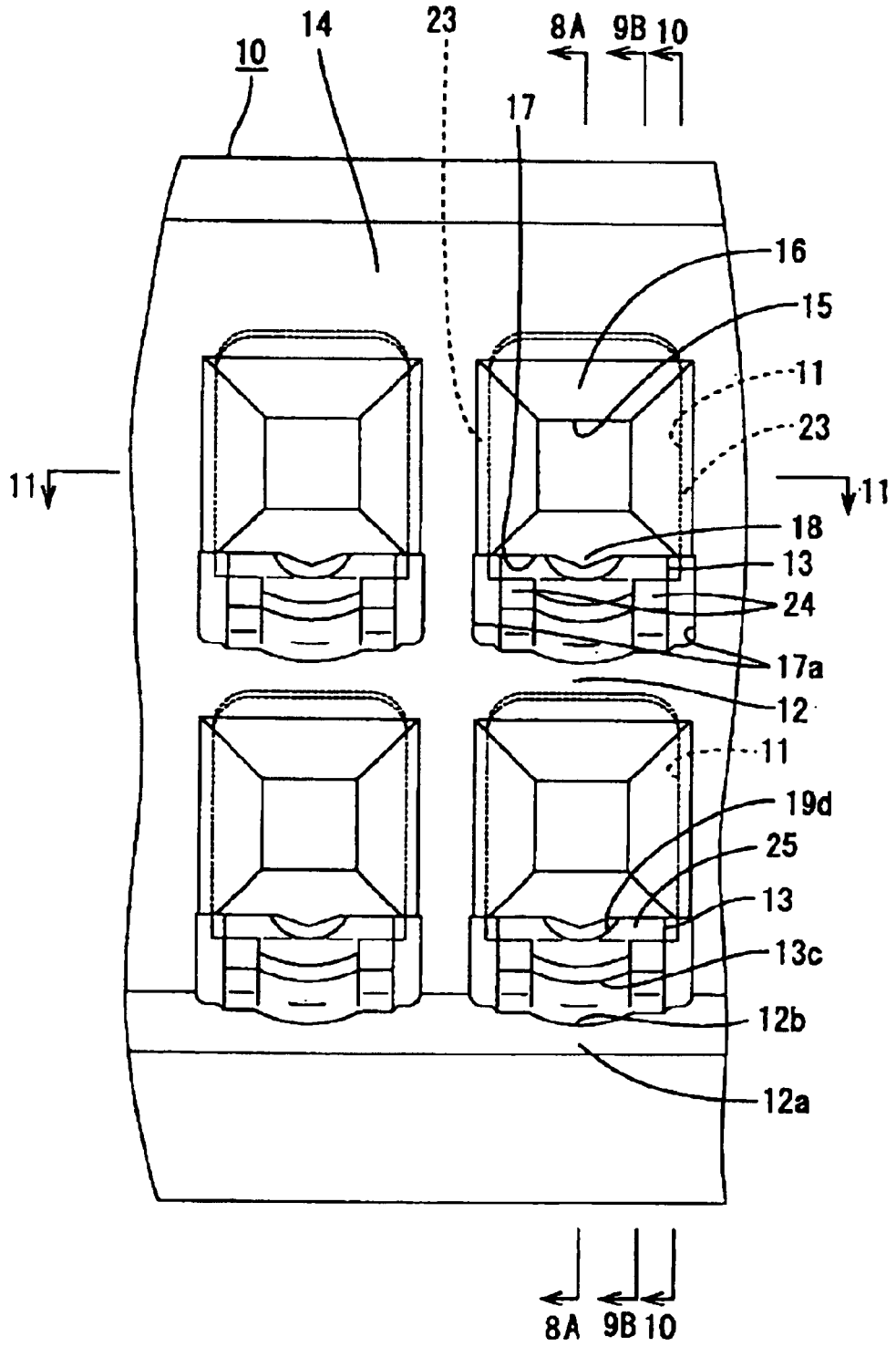
FIG. 1 is a front view of a female housing according to one embodiment of the invention.
Figure 8:
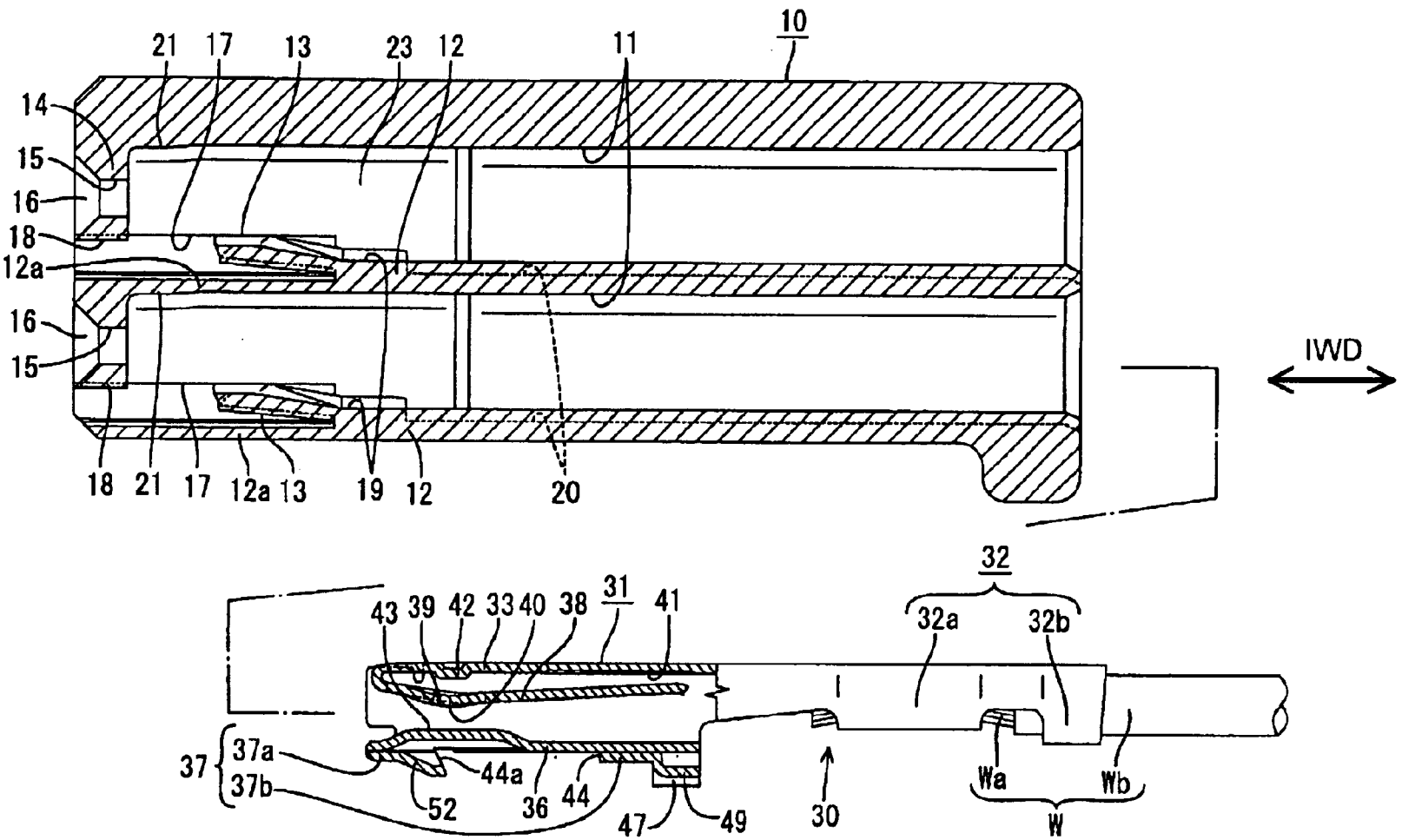
FIG. 8 is a side view in section (the female housing is shown by a section along 8A—8A of FIG. 1 and the female terminal fitting is shown by a section along 8B—8B of FIG. 4) showing a state before the female terminal fitting is inserted into the female housing.

The female housing 10 is molded of a resin by front and rear molds that are closed and opened substantially along forward and backward directions. Cavities 11 are arranged substantially side-by-side at two stages in the female housing 10, as shown in FIGS. 1 and 8, and are dimensioned to receive the female terminal fittings 30 from behind. Each cavity 11 has a bottom wall 12, and a lock 13 projects from the bottom wall 12 into each cavity 11. Each lock 13 is configured to engage the female terminal fitting 30 that has been inserted into the cavity 11. The female housing 10 also has a front wall 14 that defines a front-limit position for the terminal fittings 30 in the cavity 11. The front wall 14 of the female housing 10 is formed with tab insertion holes 15 for receiving tabs of the mating male terminal fittings that are inserted into the cavities 11 from the front. Converging or tapered guide surfaces 16 are formed at the front edges of the tab insertion holes 15 over substantially the entire periphery, so that the tabs can be guided smoothly into the cavities 11. Mold removal holes 17 are formed on the front wall 14 of the female housing 10 below the tab insertion holes 15. The mold-removal holes 17 are used to remove the front mold that forms the lock 13 when the forward part of the female housing 10 is molded. A substantially triangular projection 18 projects down at a widthwise center of the upper end of each mold-removal hole 17 and the guide surface 16 extends continuously onto the projection 18.

About the front quarter of the bottom wall 12 of each cavity 11 has a lowered portion 12*a*, and the lock 13 is cantilevered forward from the resulting step. This lock 13 inclines up and gradually projects into the cavity 11. The portion of the lock 13 that projects into the cavity 11 is pressed as the female terminal fitting 30 is inserted into the cavity 11. Thus, the lock 13 is deformed resiliently down in the deformation direction DD about a base end as a supporting point. During this resilient deformation, the lock 13 retracts into a deformation permitting space in the lowered portion 12*a* of the bottom wall 12. A locking projection 52 of the female terminal fitting 30 enters a space before the lock 13. The lowered portion 12*a* of the bottom wall 12 faces the lock 13 from below and prevents an excessive resilient deformation of the lock 13 by engaging the lower surface of the lock 13 before the lock 13 deforms beyond its resiliency limit. The lock 13 is covered and protected by the lowered portion 12*a* of the bottom wall 12, which is connected with the front wall 14 over substantially the entire width without being exposed to the cavity 11 below or to the outside below the female housing 10.

Figure 2:
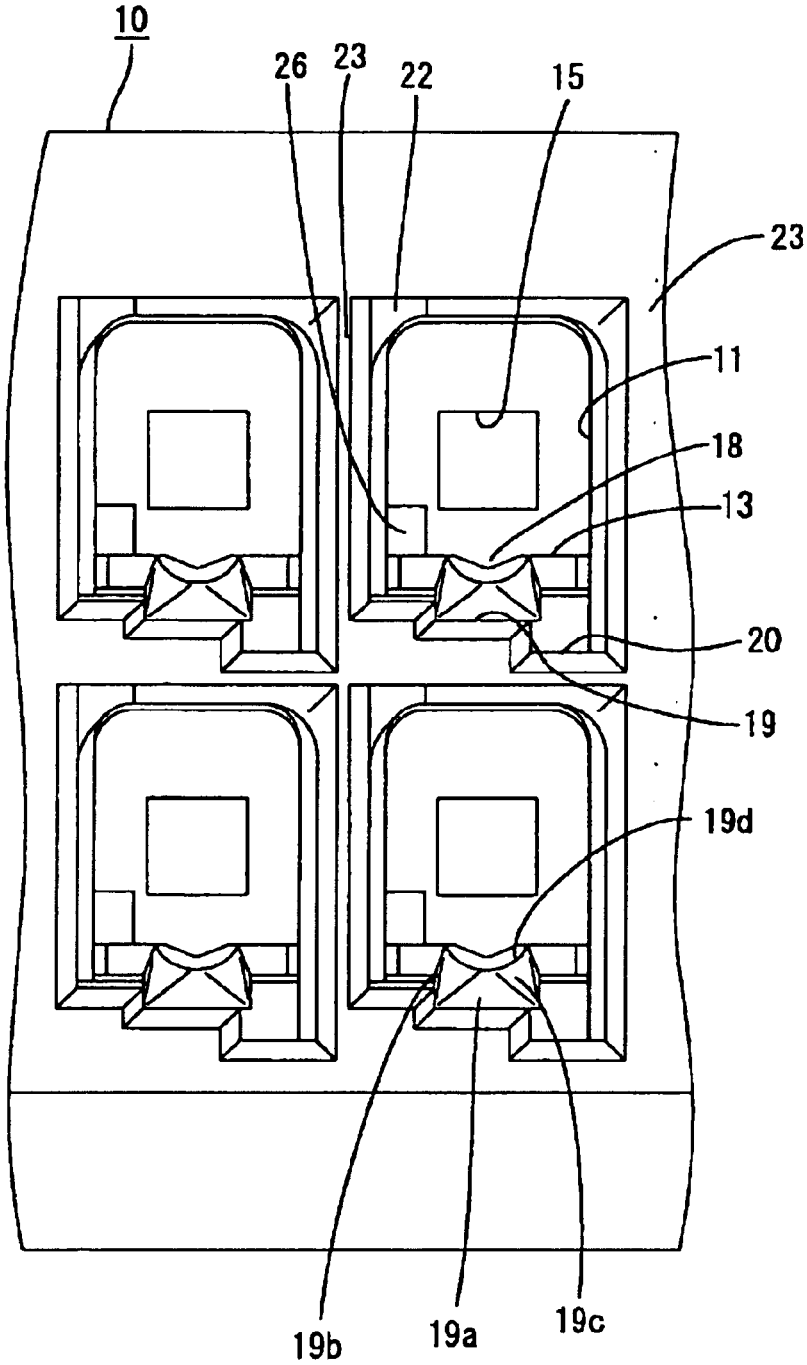
FIG. 2 is a rear view of the female housing.

A projection-inserting groove 19 is formed substantially in the widthwise center of the bottom wall 12, and a stabilizer-inserting groove 20 is formed at the right side of the projection-inserting groove 19 in FIG. 2. The stabilizer-inserting groove 20 is deeper than the projection-inserting groove 19. The projection-inserting groove 19 is substantially continuous with the lock 13, whereas the front end of the stabilizer-inserting groove 20 is slightly behind the lock 13. Accordingly, the bottom wall 12, the projection-inserting groove 19 and the stabilizer-insertion groove 20 define a stair shape in the widthwise direction (see FIG. 2).

Figure 11:
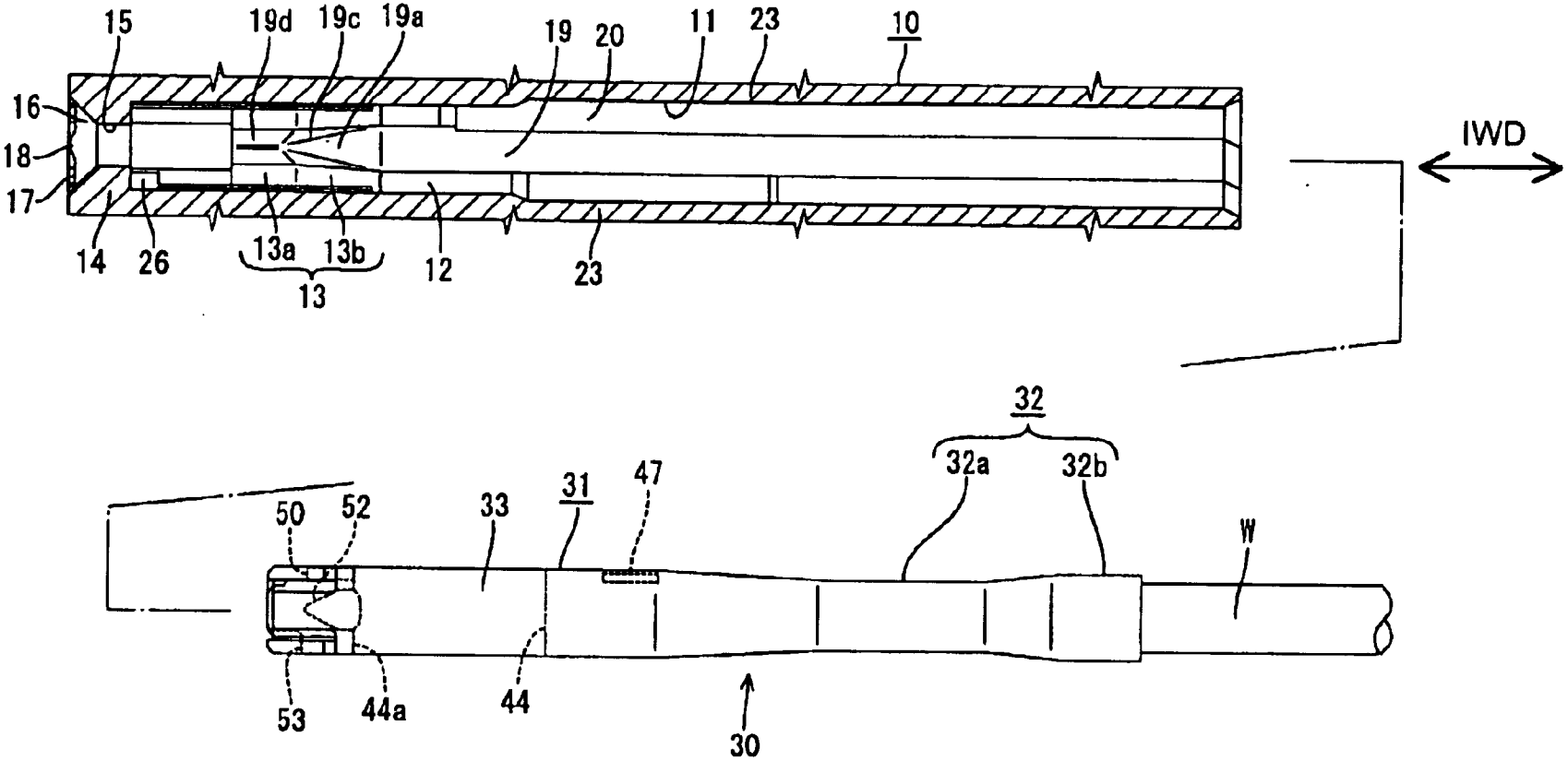
FIG. 11 is a side view in section (the female housing is shown by a section along 11—11 of FIG. 1 and the female terminal fitting is shown by a plan view) showing the state before the female terminal fitting is inserted into the female housing.

A projection 21 is provided at the front end of the upper surface of the cavity 11 and gradually projects down toward the lock 13 over the entire width of the cavity 11. The projection 21 pushes the front end of the female terminal fitting 30 toward the lock 13 as the female terminal fitting 30 is inserted into the cavity 11, and hence increases the depth of engagement with the lock 13. The peripheral edge of the rear end of the cavity 11 is inclined in and to the front over substantially the entire periphery to guide the female terminal fitting 30. A restriction 22 is at an upper-left position of the peripheral edge of the rear end of the cavity 11 in FIG. 2 and extends at an angle to the inserting and withdrawing directions IWD of the female terminal fitting 30. The restriction 22 contacts the stabilizer 47 when the female terminal fitting 30 is inserted improperly into the cavity 11, thereby hindering insertion. Further, opposite sidewalls 23 of the cavity 11 bulge so that a substantially front half is narrower than a substantially rear half as shown in FIG. 11.

Figure 3:
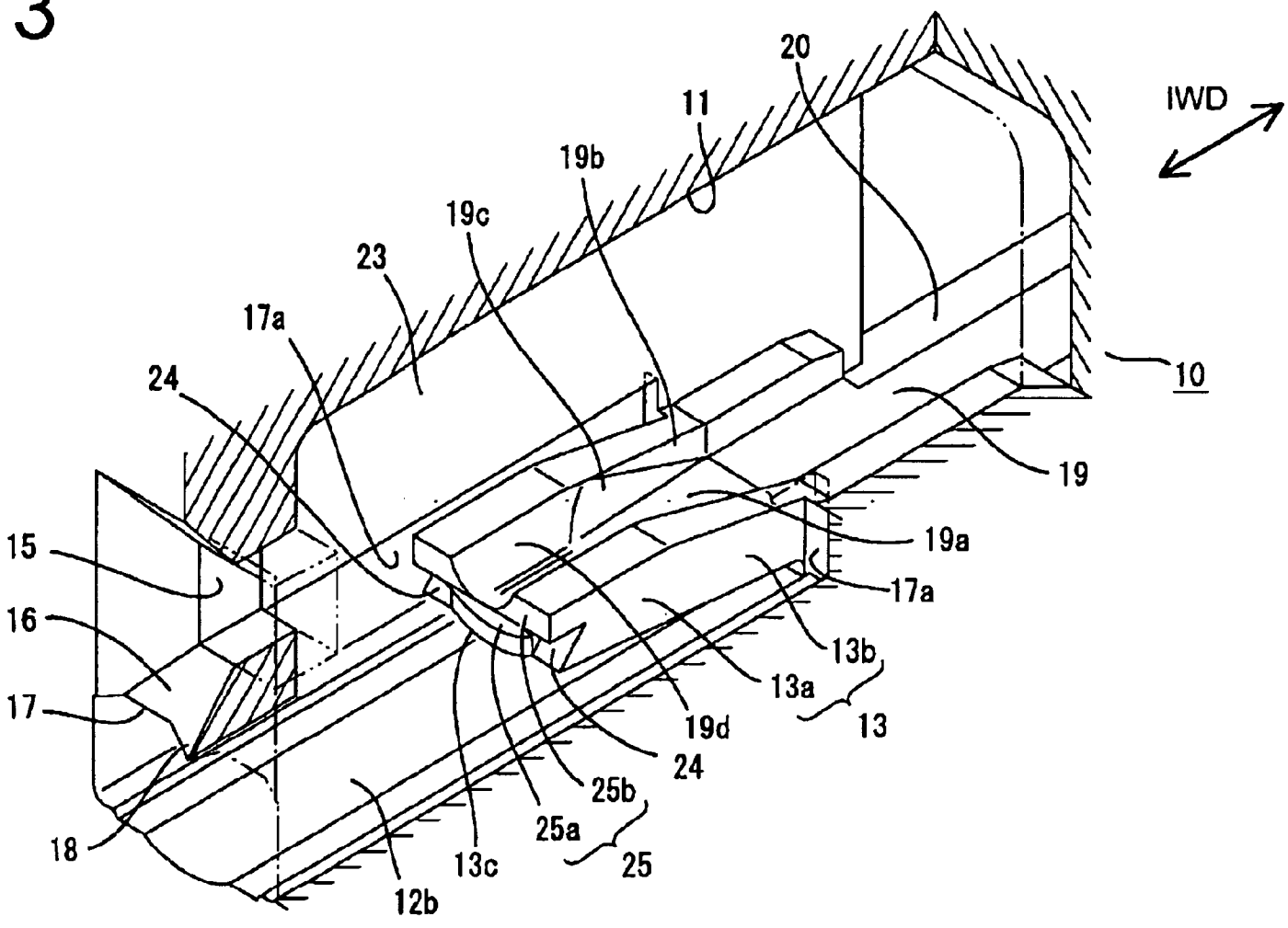
FIG. 3 is a perspective view partly in section of the female housing.

The lower surface of the lock 13 is slanted and inclines moderately up to the front over substantially the entire length of the lock 13, as shown in FIG. 3. The upper surface of the lock 13 is a slanted slightly steeper than the lower surface at a rear part 13*b* of the lock 13, but is substantially horizontal and parallel to the inserting and withdrawing directions IWD of the terminal fitting 30 at a front part 13*a* of the lock 13. The projection-inserting groove 19 is formed continuously along the upper surface of the lock 13 substantially at the widthwise center of the lock 13. The section of the projection-inserting groove 19 that extends along the rear part 13*b* of the lock 13 narrows gradually to the front. This narrowing section of the projection-inserting groove 19 is defined by a bottom surface 19*a*, a pair of planar vertical side surfaces 19*b* and a pair of inwardly slanted surfaces 19*c* that couple the opposite side surfaces 19*b* and the bottom surface 19*a*. The section of the projection-inserting groove 19 that extends along the front part 13*a* of the lock 13 defines an arcuate surface 19*d* that has a constant width over substantially the entire length. An arcuate surface 13*c* extends along the entire length of the widthwise center of the lower surface of the lock 13 and is curved more moderately than the arcuate surface 19*d* of the projection-introducing groove 19. A similar arcuate surface 12*b* is formed at the lowered portion 12*a* of the bottom wall 12.

The lock 13 has a constant width along its length and is slightly narrower than the cavity 11. The mold-removal hole 17 for the lock 13 is formed in the front wall 14 of the female housing 10 and is wider than the cavity 11. Accordingly, notches 17 are formed in the opposite sidewalls 23 of the cavity 11 and face the opposite sides of the lock 13. The thickness, of the mold for molding the lock 13 can be made larger by the widths of the notches 17*a* and, thus, a necessary strength can be secured for the mold. Conversely, the width of the lock 13 is increased and the strength is enhanced.

Two forwardly open maneuverable recesses 24 are formed at the lower front of the lock 13 and extend along about ⅗ of the total height of the lock 13. The maneuverable recesses 24 are exposed forward to outside even if the female terminal fitting 30 is locked by the lock 13 (see FIG. 17), and can be pressed down in the deformation direction DD by a jig inserted through the mold-removal hole 17 from the front. Each maneuverable recess 24 is substantially triangular when the lock 13 is viewed sideways. The upper surface of the maneuverable recess 24 is substantially horizontal, whereas the lower surface thereof is inclined up and to the back (see FIG. 3).

A projection 25 projects forward over the entire width of the lower front end of the lock 13 and extends about ⅔ of the total height of the front end of the lock 13. The projection 25 can interact with the locking projection 52 when the lock 13 is engaged with the female terminal fitting 30. The projection 25 has a lower part 25*a* with projecting length that gradually increases toward the upper end and an upper part 25*b* above the maneuverable recesses 24 that has a constant projecting length. Thus, the front surface of the lower part 25*a* of the projection 25 slants up and to the front, whereas the front surface of the upper part 25*b* is substantially vertical.

Figure 10:
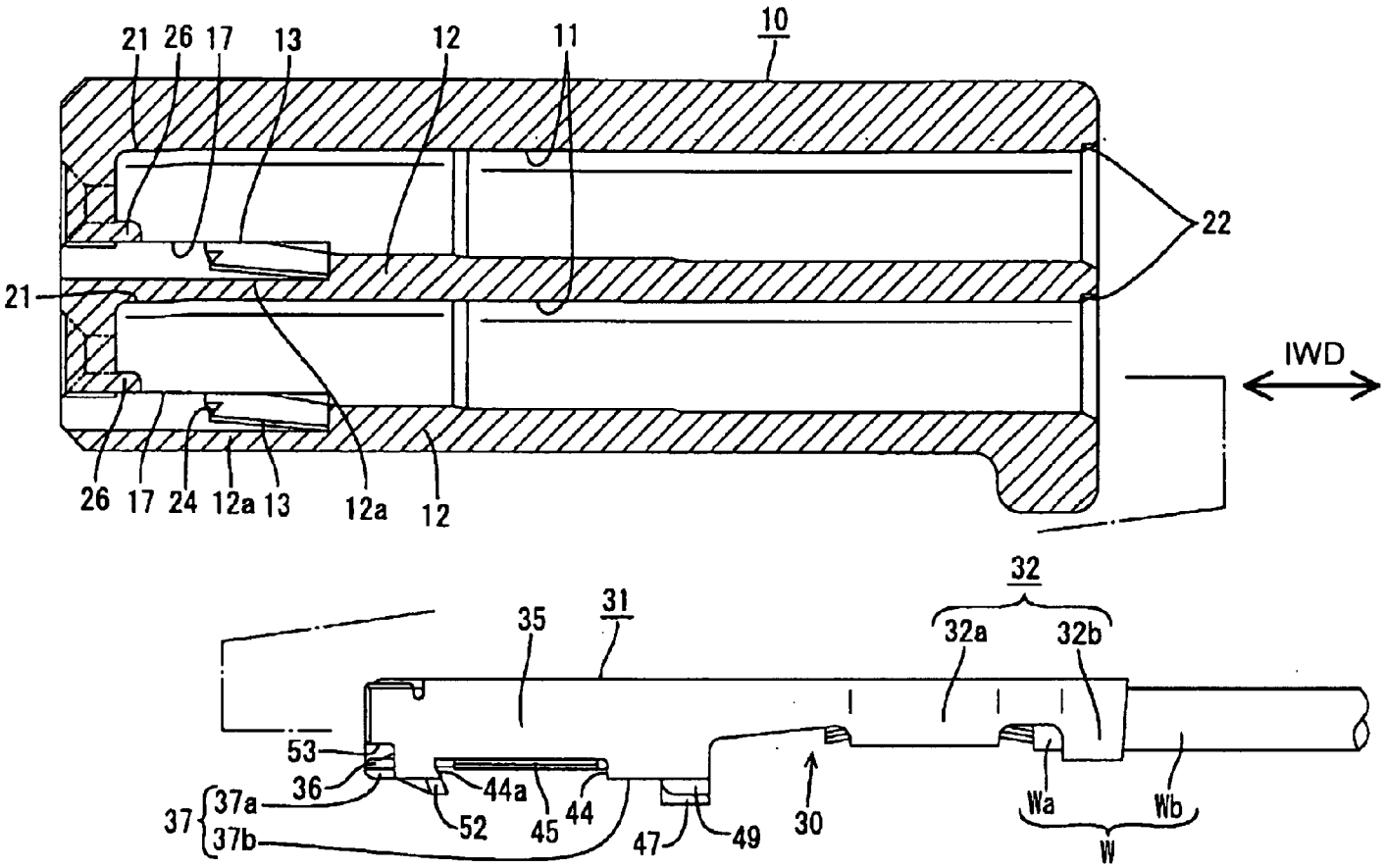
FIG. 10 is a side view in section (the female housing is shown by a section along 10—10 of FIG. 1 and the female terminal fitting is shown by a right side view) showing the state before the female terminal fitting is inserted into the female housing.

A supporting projection 26 projects in at a corner of the front end of the cavity 11, as shown in FIGS. 2 and 10, and is fittable into a fittable groove 53 in the female terminal fitting 30 to prevent the female terminal fitting 30 from being inclined vertically. The supporting projection 26 is substantially block-shaped and is coupled to the front wall 14 of the female housing 10 and the left sidewall 23 of the cavity 11 for enhanced strength. Additionally, the supporting projection 26 is displaced up with respect to the lock 13 so that the lower surface of the supporting projection 26 faces the mold-removal hole 17.

Figure 5:
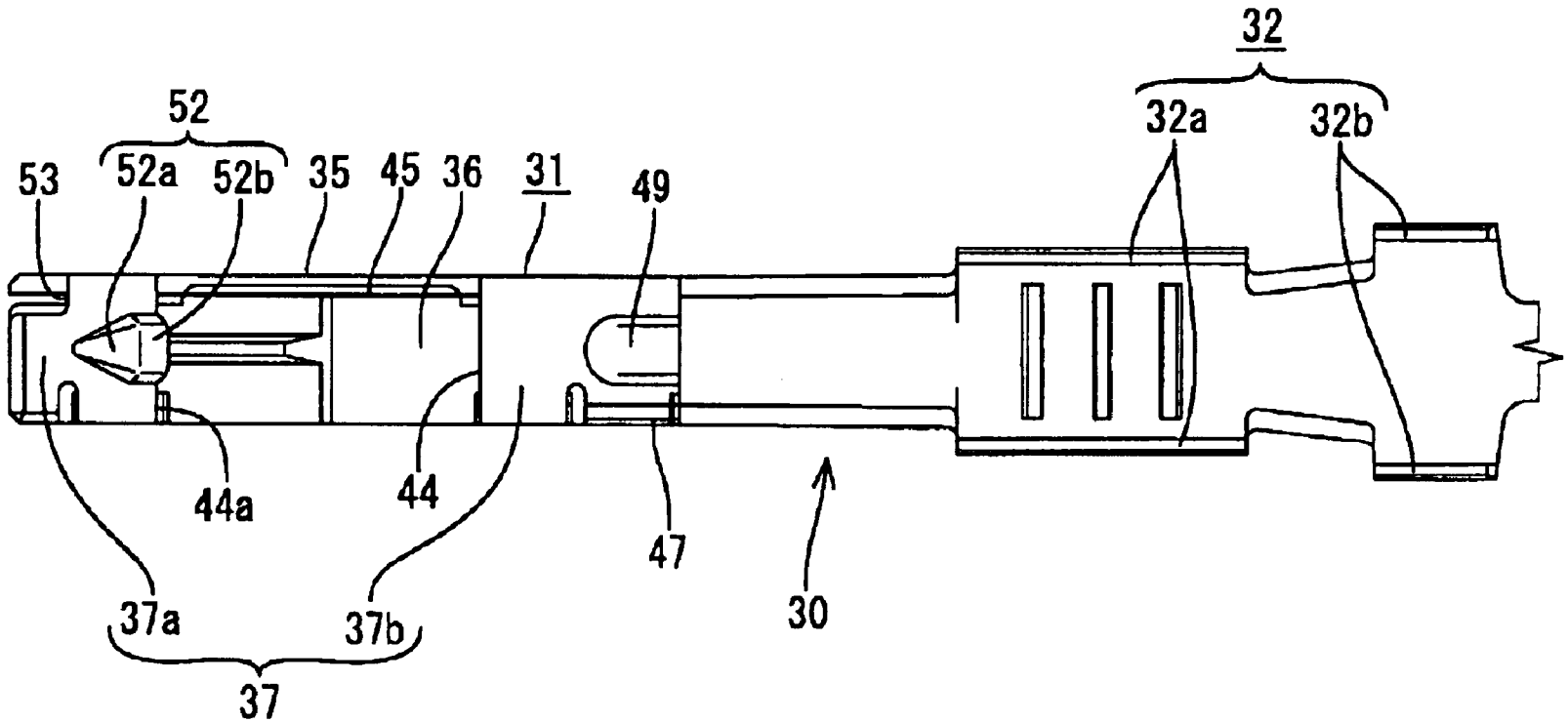
FIG. 5 is a bottom view of the female terminal fitting.

The female terminal fitting 30 is formed by embossing, folding and/or bending a metallic material that has been stamped or cut into a specified shape. The female terminal fitting 30, as shown in FIGS. 5 and 8, has a main body 31 substantially in the form of a box with open front and rear ends and a barrel 32 to be crimped, bent or folded into connection with an end of a wire W. The barrel 32 has a front pair of crimping pieces 32*a* for crimped connection with a core Wa of the wire W, and a rear pair of crimping pieces 32*b* for crimped connection with an insulated portion Wb of the wire W.

The main body 31 has a ceiling wall 33 that extends in forward and backward directions, left and right sidewalls 34, 35 that extend down from opposite lateral edges of the ceiling wall 33, a bottom wall 36 that extends from the projecting end of the left sidewall 34 of FIG. 4 to face the ceiling wall 33, and an outer wall 37 that extends from the projecting end of the right sidewall 34 of FIG. 4 to be placed below and outside the bottom wall 36.

The front end of the ceiling wall 33 is retracted back as compared to the front ends of the other walls 34, 35, 36 and 37, and a resilient contact piece 38 projects from this front end as shown in FIG. 8. The resilient contact piece 38 is formed from a tongue that extends from the front end of the ceiling wall 33 and is folded to face the ceiling wall 33 and the bottom wall 36. Thus, the resilient contact piece 38 is supported only at one end and has a substantially triangular shape. The resilient contact piece 38 has a forward-inclined portion and a backward-inclined portion that are provided one after the other behind a substantially U-shaped front fold. A long narrow elliptical bulge 39 is embossed to project toward the bottom wall 36 and extends from the forward-inclined portion to the backward-inclined portion. The peak of the bulge 39 defines a contact 40 for contacting the tab of the mating male terminal fitting. The resilient contact piece 38 deforms resiliently about the front fold and approaches the ceiling wall 33 as the tab of the male terminal fitting presses the contact 40. The end of the resilient contact piece 38 can be brought into contact with the inner surface of the ceiling wall 33 during the resilient deformation. A recess 41 in the ceiling wall 33 enlarges a degree of resilient deformation of the resilient contact piece 38 and prevents the deformed resilient contact piece 38 from a widthwise displacement.

An excessive deformation preventing projection 42 is embossed in the ceiling wall 33 and projects toward the contact 40. Engagement of the resilient contact piece 38 with the excessive deformation preventing projection 42 prevents deformation of the resilient contact piece 38 beyond its resiliency limit. Further, a receiving portion 43 bulges up from the bottom wall 36 at a position aligned with the bulge 39 and the locking projection 52. Thus, the tab of the male terminal fitting can be squeezed between the receiving portion 43 and the resilient contact piece 38.

A cut-away 44 divides the outer wall 37 into front and rear portions 37*a* and 37*b*, as shown in FIGS. 5 and 8. The cut-away 44 is formed over substantially the entire width of the outer wall and is substantially at its longitudinal middle. The lock 13 can enter the cut-away portion 44 over its entire length when the female terminal fitting 30 is inserted into the cavity 11, and can engage a front cut end surface 44*a* of the cut-away portion 44. The front cut end surface 44*a* of the cut-away portion 44 is inclined up and to the back over its entire area. The cut-away portion 44 is slightly shorter than half the length of the outer wall 37 and extends up to the bottom end of the sidewall 35 at the upper side in FIG. 5. A bulging piece 45 extends from the projecting end of the bottom wall 36 and contacts the bottom end surface of the sidewall 35 to hold the bottom wall 36 substantially horizontally. The entire area of the bottom wall 36, except a contact portion of the bulging piece 45 with the sidewall 35, is slightly lower than this contact portion, thereby increasing a depth of engagement with the lock 13. The front portion 37*a* of the outer wall 37 is slightly shorter than the rear portion 37*b* in forward and backward directions.

Figure 6:
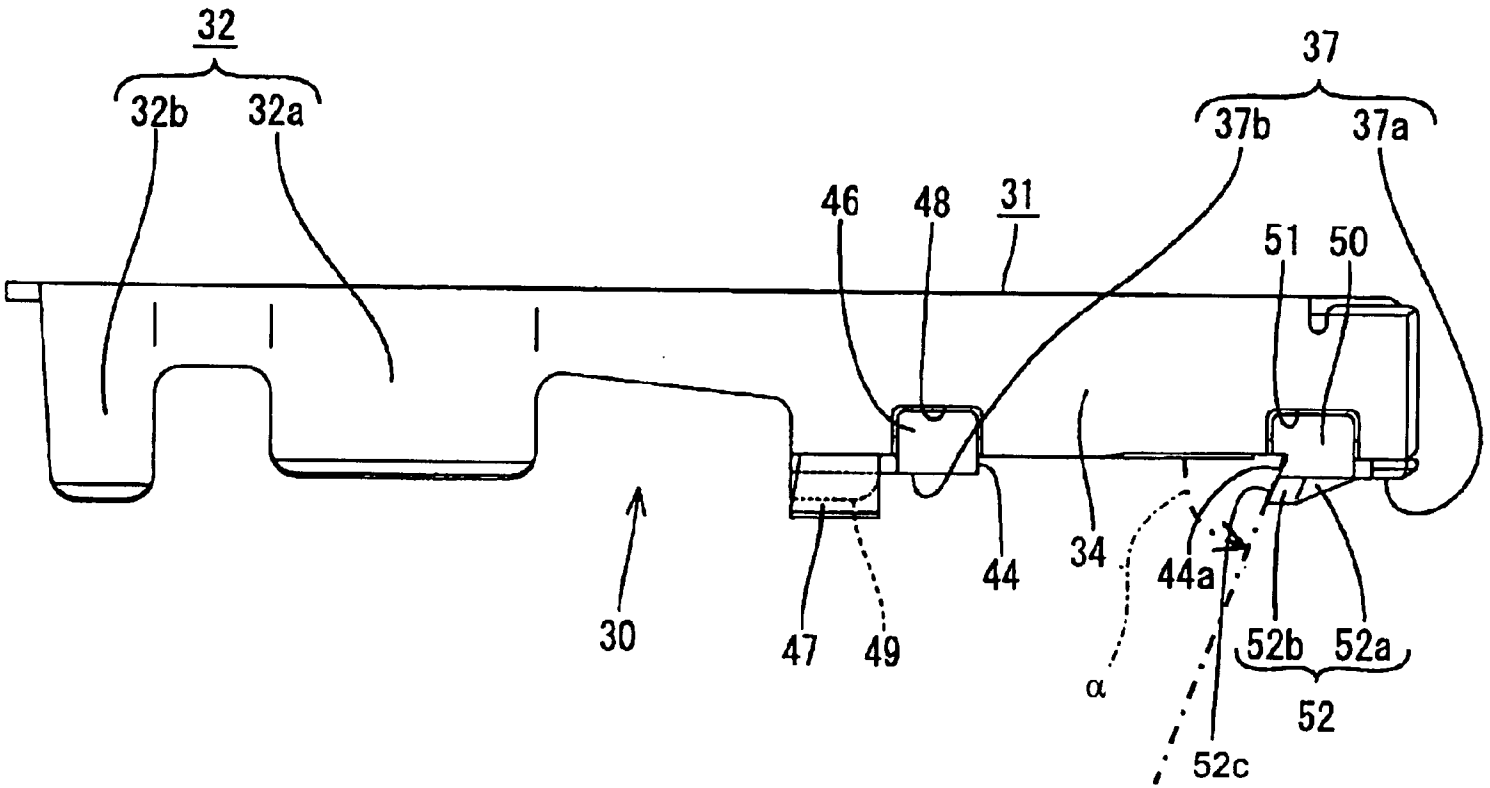
FIG. 6 is a left side view of the female terminal fitting.

A rear-portion holding piece 46 is bent up from the projecting end of the rear portion 37*b* of the outer wall 37, as shown in FIG. 6, and fits into a rear portion holding groove 48 to prevent loose forward and backward movement of the rear portion 37*b*. A stabilizer 47 is bent down from the projecting end of the rear portion 37*b* of the outer wall 37 and fits in the stabilizer-inserting groove 20 to guide the insertion of the female terminal fitting 30 into the cavity 11. The front end of the rear-portion holding piece 46 and the front end of the rear portion 37*b* are substantially aligned with each other. Similarly, the rear end of the stabilizer 47 and the rear end of the rear portion 37*b* are substantially aligned with each other. A projection 49 is embossed to project out at the widthwise center of the rear end of the rear portion 37*b* and has a length substantially equal to the length of the stabilizer 47. The projection 49 contacts the projection-inserting groove 19 when the female terminal fitting 30 is inserted into the cavity 11.

A front-portion holding piece 50 is bent up from the projecting end of the front portion 37*a* of the outer wall 37 and fits into a front-portion holding groove 51 in the side wall 34, as shown in FIG. 6, to prevent the front portion 37*a* from making loose forward and backward movements. The front-portion holding piece 50 projects more backward than the front portion 37*a* of the outer wall 37. The cut-away portion 44 extends into the base end of the front-portion holding piece 50, and the cut end surface 44*a* thereof is inclined in and up to the back as already described. A side end of the lock 13 is engageable with this cut end surface 44*a*.

Figure 4:
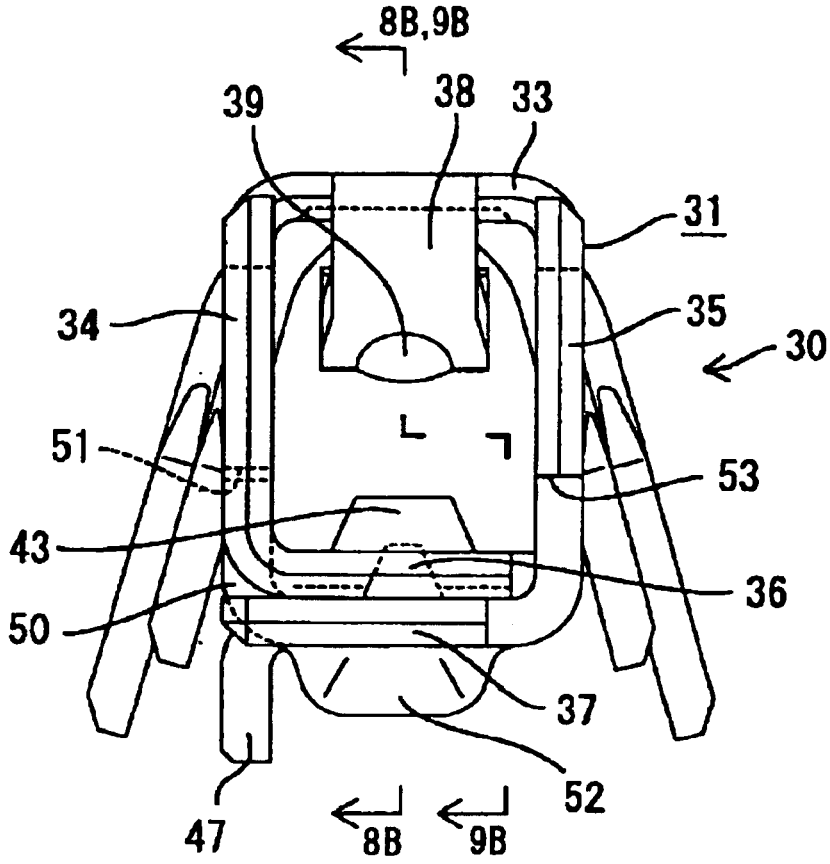
FIG. 4 is a front view of a female terminal fitting.
Figure 7:
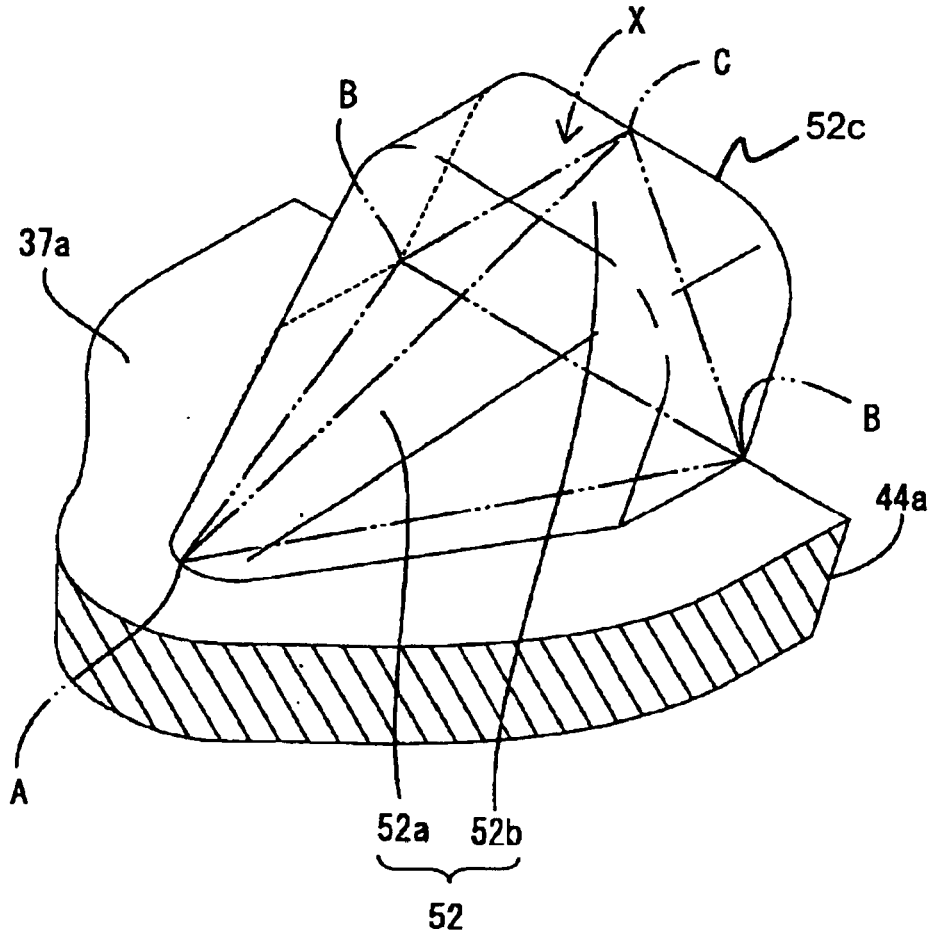
FIG. 7 is an enlarged perspective view showing a locking projection and an imaginary triangular pyramid.

A locking projection 52 is embossed out from the front portion 37*a* of the outer wall 37 at a position displaced slightly to the left of center in FIG. 4 and adjacent the front cut end of the cut-away portion 44. The locking projection 52, as shown in FIGS. 5 to 7, is tapered so that the width and height of the locking projection 52 gradually decrease toward a vertex at the front end. More particularly, the locking projection 52 has a pyramid portion 52*a* formed by three slanted surfaces and a rectangular tube portion 52*b* with a substantially constant width and height and formed by three sequentially connected side surfaces. The pyramid portion 52*a* of the locking projection 52 is tapered and has a slightly rounded front end, so that the locking projection 52 can be inserted smoothly along the projection-inserting groove 19 in the process of inserting the female terminal fitting 30 into the cavity 11. The rectangular tube portion 52*b* of the locking projection 52 overhangs back substantially along the inclination of the front cut end surface 44*a* of the cut-away portion 44 and projects more back towards the cut-away portion 44 than the front portion 37*a* of the outer wall 37. Thus, the locking projection 52 is substantially parallel to the undercut front cut end surface 44*a* and is inclined at an acute angle $\alpha$ with respect to the insertion and withdrawal directions IWD and with respect to the plane defined by the cut-away portion 44.

Figure 9:
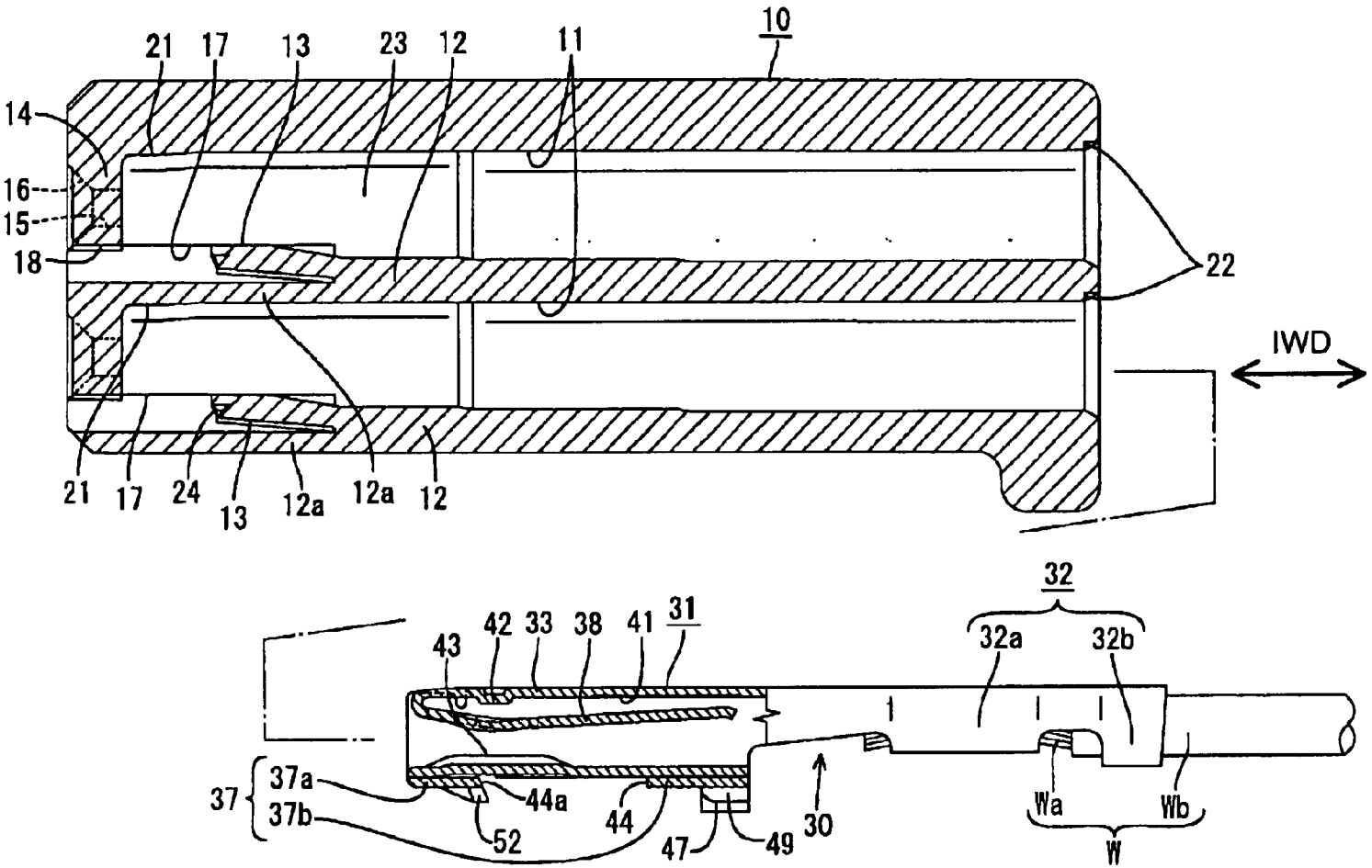
FIG. 9 is a side view in section (the female housing is shown by a section along 9A—9A of FIG. 1 and the female terminal fitting is shown by a section along 9B—9B of FIG. 4) showing the state before the female terminal fitting is inserted into the female housing.

The locking projection 52 projects up to substantially the same height as the projection 49, and is insertable into the projection-inserting groove 19 of the cavity 11. The outward-projecting end of the rectangular tube portion 52*b* of the locking projection 52 is set to reach a part of the lock 13 below the projecting portion 25, thus ensuring a sufficient depth of engagement with the lock 13. The rear end 52*c* of the locking projection 52 is engageable with the lock 13 and is formed by the front cut end surface 44*a* of the cut-away portion 44, which inclines in and up to the back. The rear end surfaces of the front portion 37*a* of the outer wall 37 at opposite sides of the locking projection 52 also are formed by the inwardly and upwardly inclined front cut end surface 44*a* and are engageable with the lock 13, as shown in FIG. 9.

The locking projection 52 projects further out than an imaginary triangular pyramid X shown in FIG. 7. The imaginary triangular pyramid X has a vertex A at the front end of the locking projection 52 and is formed by connecting this vertex A with a pair of base end points B located at the rear edge of the front portion 37*a* of the outer wall 37 and an outward projecting end point C at substantially the middle of the rear end 52*c* of the locking projection 52. The outer surfaces of the locking projection 52 project more outward than any side of the imaginary triangular pyramid X (i.e. straight lines connecting the vertex A and the base end points B, straight line connecting the vertex A and the projecting end point C, straight lines connecting the base end points B and the projecting end point C). Thus, the inner volume of the locking projection 52 is larger than that of the imaginary triangular pyramid X.

A forwardly open fittable groove 53 is formed at a corner between the front portion 37*a* of the outer wall 37 and the right sidewall 35 of FIG. 4. Thus, the fittable groove 53 is at a side opposite the front-portion holding piece 50 with respect to widthwise direction. The supporting projection 26 at the front end of the cavity 11 is engageable with this fittable groove 53 as the female terminal fitting 30 is inserted into the cavity 11. Thus, the female terminal fitting 30 is supported so as not to move loosely in vertical directions that intersect the inserting and withdrawing directions IWD of the female terminal fitting 30.

The connector is assembled by crimping the barrel 32 of the female terminal fitting 30 into connection with the wire W, and then inserting the female terminal fitting 30 into the cavity 11 from behind, as shown in FIGS. 8 to 11. The female terminal fitting 30 cannot be inserted in an improper orientation because the stabilizer 47 would face up and would contact the restricting portion 22 formed at the peripheral edge of the rear end of the cavity. In this way, an upside-down insertion of the female terminal fitting 30 is prevented.

Figure 12:
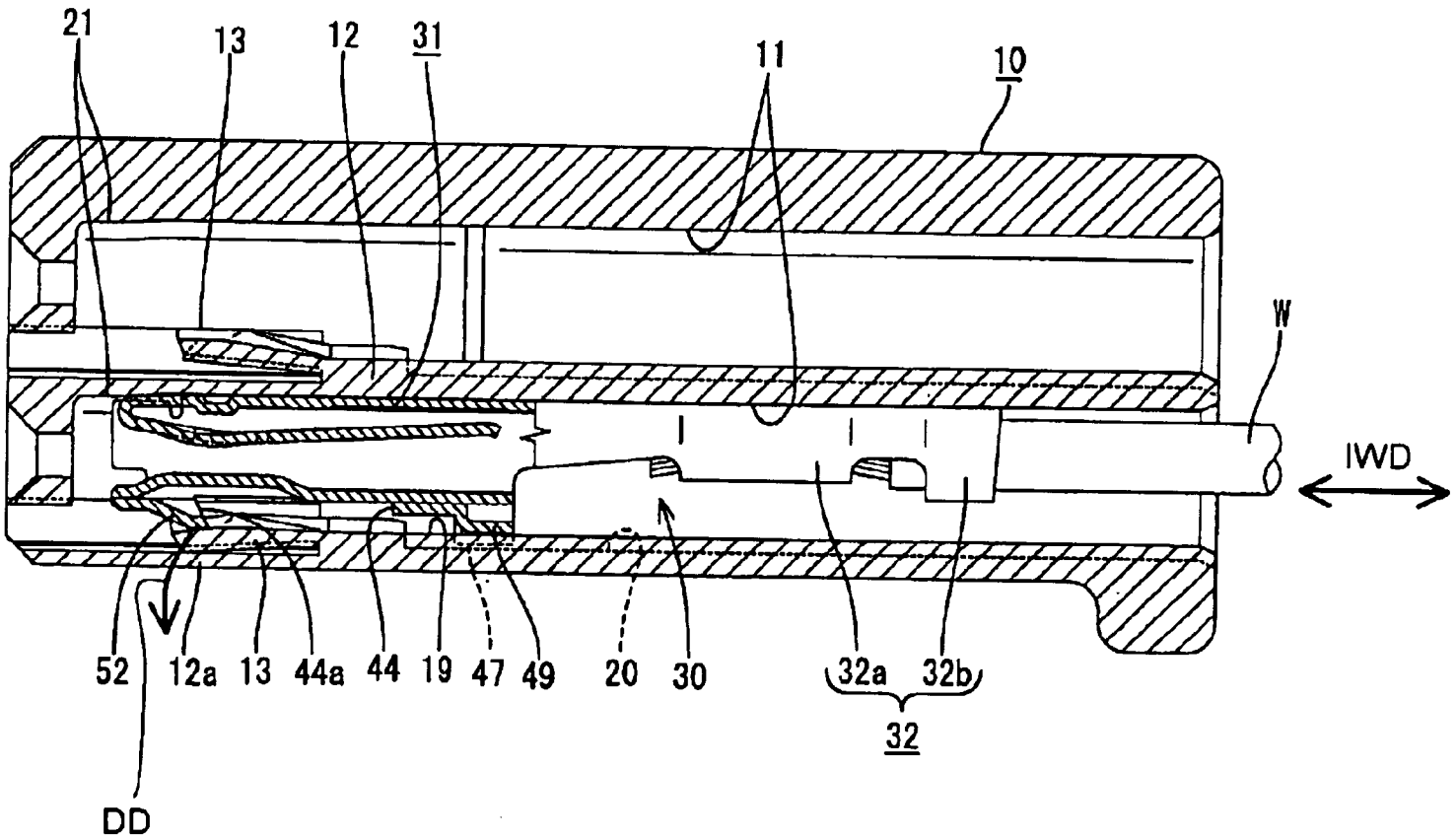
FIG. 12 is a side view in section similar to FIG. 8, but showing an intermediate stage of inserting the female terminal fitting into the housing.
Figure 13:
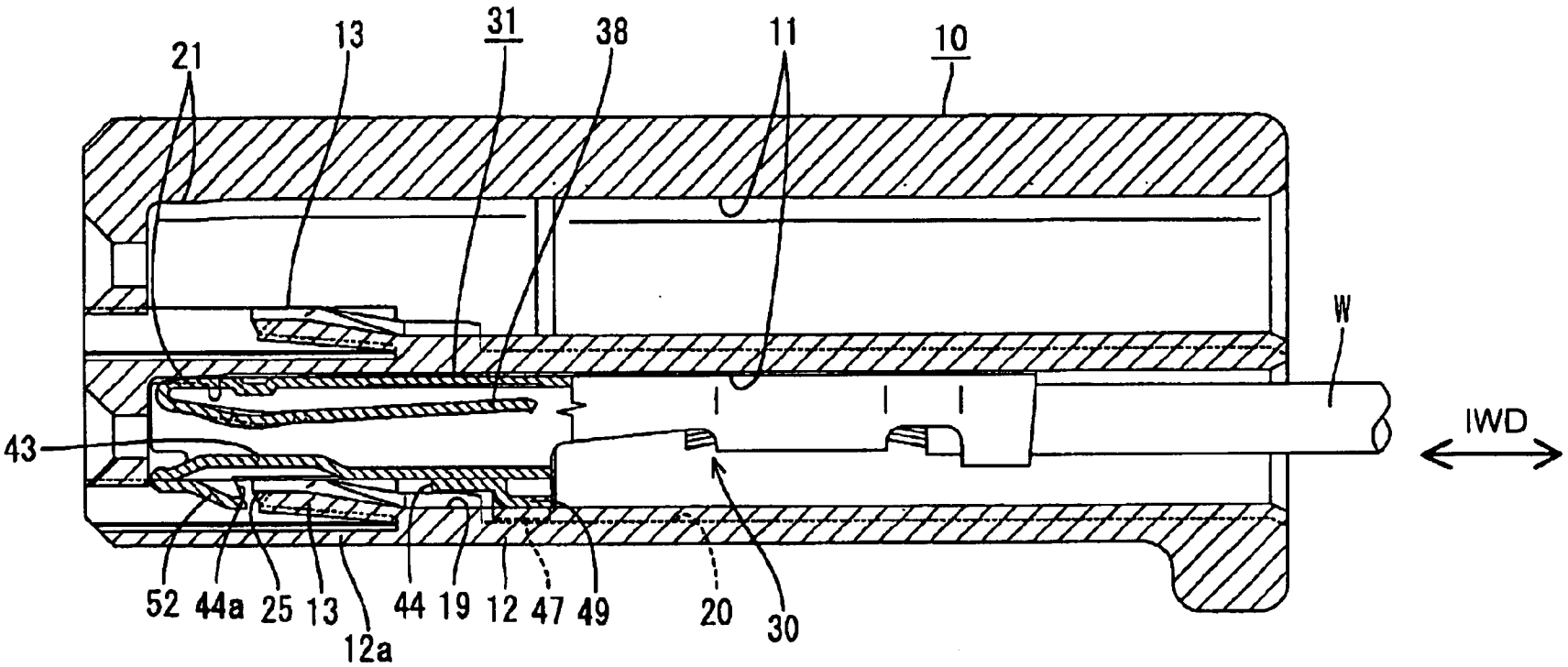
FIG. 13 is a side view in section similar to FIG. 8, but showing a state where the female terminal fitting is inserted in the female housing.
Figure 14:
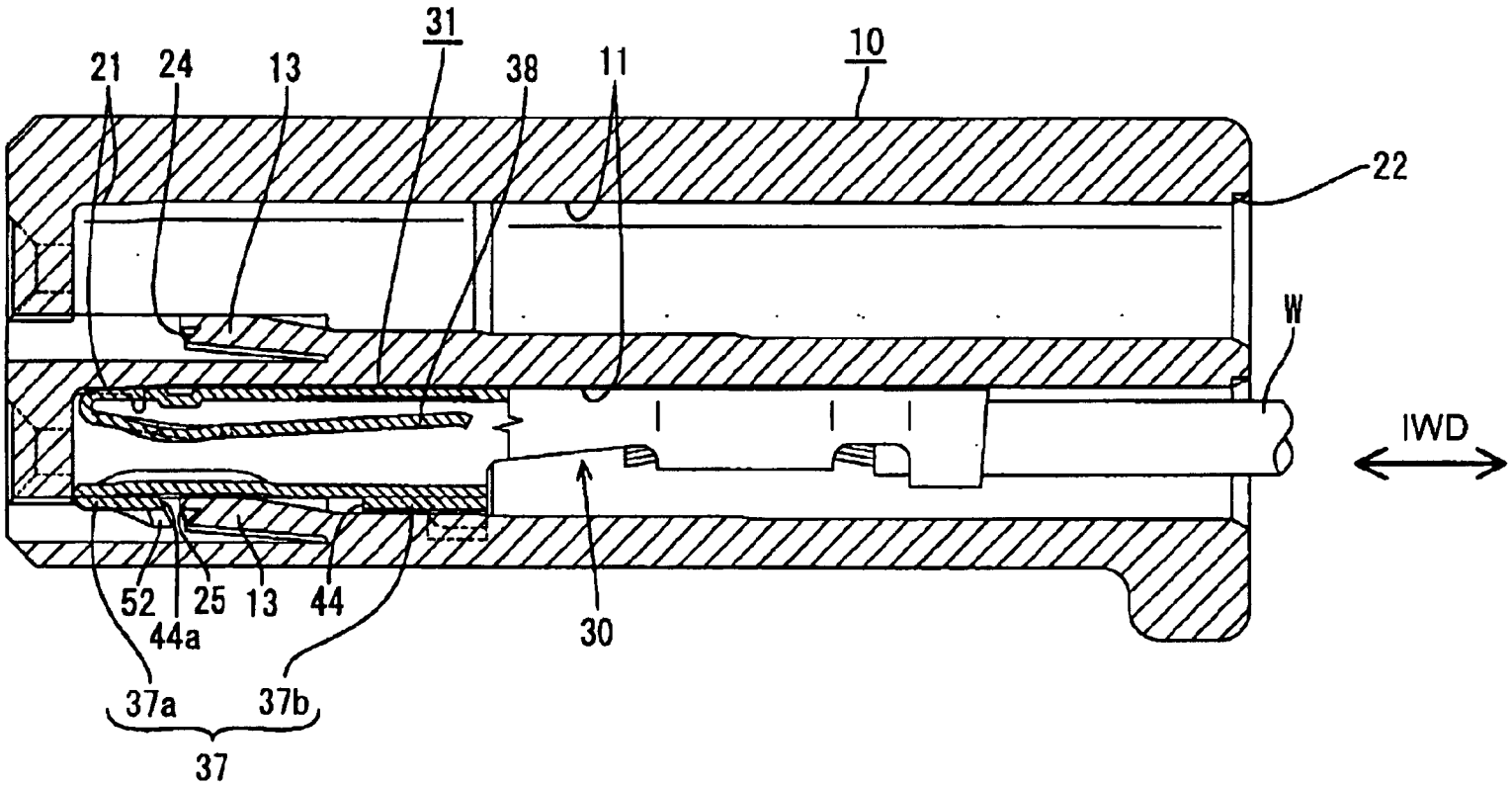
FIG. 14 is a side view in section similar to FIG. 9, but showing the state where the female terminal fitting is inserted in the female housing.

The insertion of the female terminal fitting 30 into the cavity 11 introduces locking projection 52 into the projection-inserting groove 19. The projection 49 and the stabilizer 47 then are introduced into the projection-inserting groove 19 and the stabilizer-inserting groove 20 so that the properly oriented female terminal fitting 30 can be inserted smoothly into the cavity 11 without shaking along vertical and/or transverse directions. The locking projection 52 of the female terminal fitting 30 presses the lock 13 down, as shown in FIG. 12, when the female terminal fitting 30 is inserted to a specified depth. The lock 13 is deformed resiliently in the deforming direction DD to a maximum degree when the locking projection 52 presses the front part 13*a*. During this process, the locking projection 52 is inserted smoothly along the projection-inserting groove 19 and smoothly presses the lock 13 due to the pyramidal shape with a vertex at the front end.

Figure 15:
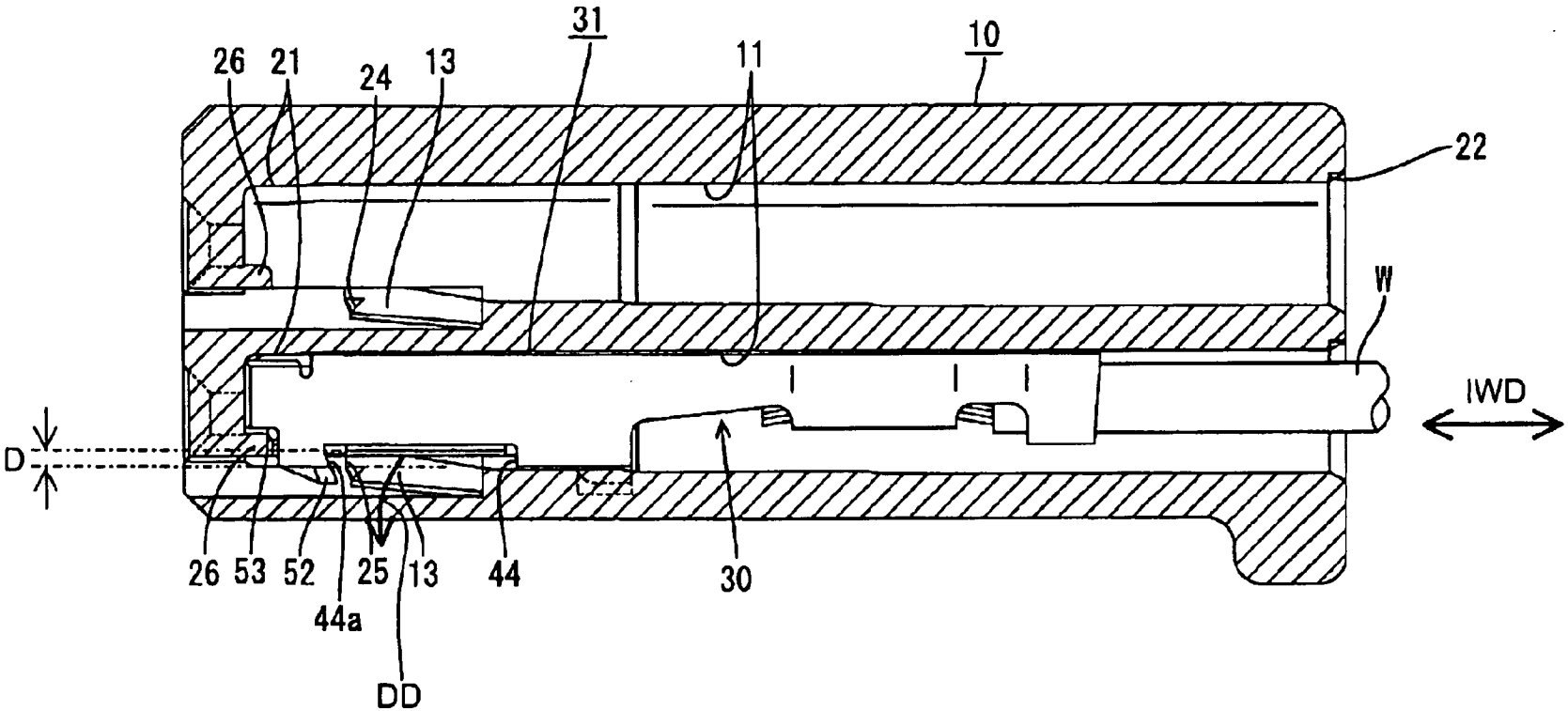
FIG. 15 is a side view in section similar to FIG. 10, but showing the state where the female terminal fitting is inserted in the female housing.
Figure 16:
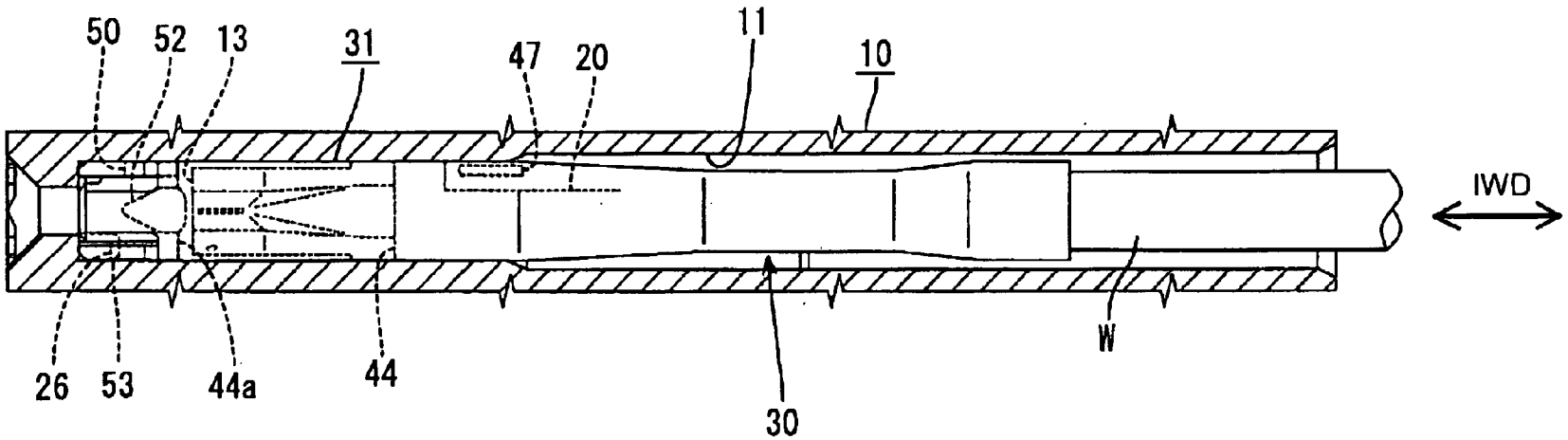
FIG. 16 is a side view in section similar to FIG. 11, but showing the state where the female terminal fitting is inserted in the female housing.
Figure 17:
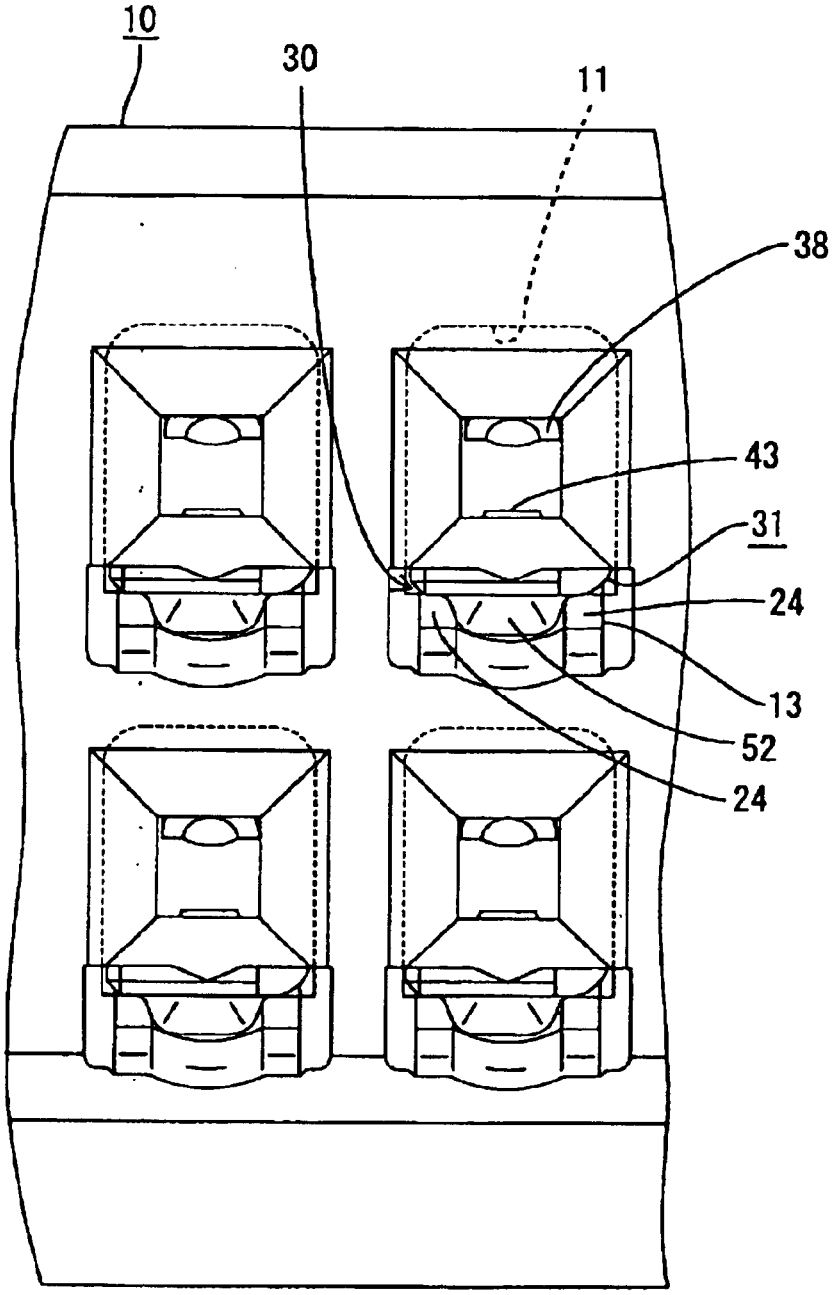
FIG. 17 is a front view showing a state where the female terminal fittings are inserted in the female housing.

The locking projection 52 moves beyond the lock 13 as the female terminal fitting 30 is inserted to a proper depth in the cavity 11. Thus, the lock 13 is restored resiliently and enters the cut-away portion 44 to lock the female terminal fitting 30, as shown in FIGS. 13 to 16. More particularly, the projection 25 of the lock 13 projects along the inclination of the cut end surface 44*a* and enters the inside of the locking projection 52. The front end of the main body 31 is pushed down by the jutting portion 21 on the ceiling surface of the cavity 11 and is urged toward the lock 13. Consequently, the depth of engagement of the lock 13 with the female terminal fitting 30 is increased. Further, vertical inclination of the female terminal fitting 30 is prevented by the engagement of the supporting projection 26 with the fittable groove 53, as shown in FIG. 15. The locking projection 52 is displaced from both maneuverable recesses 24 of the lock 13 along widthwise direction and is exposed forward to outside together with the maneuverable recesses 24 as shown in FIG. 17.

The front cut end surface 44*a* of the cut-away portion 44 is formed over substantially the entire width of the female terminal fitting 30 and reaches the front portion 37*a* of the outer wall 37 the locking projection 52 and the front-portion holding piece 50, as shown in FIGS. 13 to 16. Thus, the female terminal fitting 30 is held with a strong locking force and will not come out of the cavity 11. Further, the front cut end surface 44*a* of the cut-away portion 44 is inclined in and up to the back. Therefore, the locking force is even stronger.

A force could act on the female terminal fitting 30 via the wire W to pull the female terminal fitting 30 back from the above-described locked state. Hence, there is a possibility that the locking projection 52 of the female terminal fitting 30 will bite into the front end surface of the lock 13 and will scrape off enough of the lock 13 for the lock 13 to enter the inner space of the locking projection 52. However, the volume of the inner space of the locking projection 52 is larger than the inner volume of the imaginary triangular pyramid X shown in FIG. 7. Accordingly, a larger amount of the material of the lock 13 can enter the locking projection 52 at the time of biting. Thus, a force necessary to pull the female terminal fitting 30 back while causing the lock 13 to bite in the locking projection 52 is increased. Hence, the female terminal fitting 30 can be held strongly.

As described above, the inclination of the female terminal fitting 30 in the deforming direction DD of the lock 13 is prevented by the engagement of the supporting projection 26 with the fittable groove 53 in the female terminal fitting 30 in the cavity 11. The supporting projection 26 and the lock 13 are displaced by a distance D from each other with respect to the deforming direction DD of the locking portion 13. Therefore, the width of the lock 13 can be set independently of the supporting projection 26 by employing molds that are closed and opened along the inserting and withdrawing directions IWD of the female terminal fittings 30. Thus, sufficient forces to lock the female terminal fittings 30 can be ensured even if the female connector is miniaturized, and the female terminal fittings 30 can be firmly supported. As a result, the female connector can be miniaturized.

The supporting projection 26 projects at the front corner of the inner surface of the cavity 11 and the fittable groove 53 is recessed at the front corner of the female terminal fitting 30. Thus, the supporting projection 26 can fit in the fittable groove 53 and the female terminal fitting 30 is prevented from inclining in the deforming direction DD of the lock 13.

The resilient contact piece 38 is formed at the ceiling wall 33 of the box-shaped main body 31 of the female terminal fitting 30 for resilient contact with a mating male terminal fitting. On the other hand, the fittable groove 53 partly opens the front corner 37*a* of the outer wall 37. However, the fittable groove 53 is at the opposite side of the box-shaped main body 31 from the resilient contact piece 38 and therefore does not expose the resilient contact piece 38 to the outside. Accordingly external matter cannot interfere with the resilient contact piece 38.

A second embodiment of the invention is described with reference to FIGS. 18 to 28. In this second embodiment, a supportable projection 62 is provided on the female terminal fitting 30 and a supporting groove 60 is formed in the female housing 10 for engaging the supportable projection 62. This arrangement is instead of the fittable groove 53 and the supporting projection 26 shown in the first embodiment. Elements of the second embodiment that are the same as or similar to elements in the first embodiment are not described again, but merely are identified by the same reference numerals.

Figure 18:
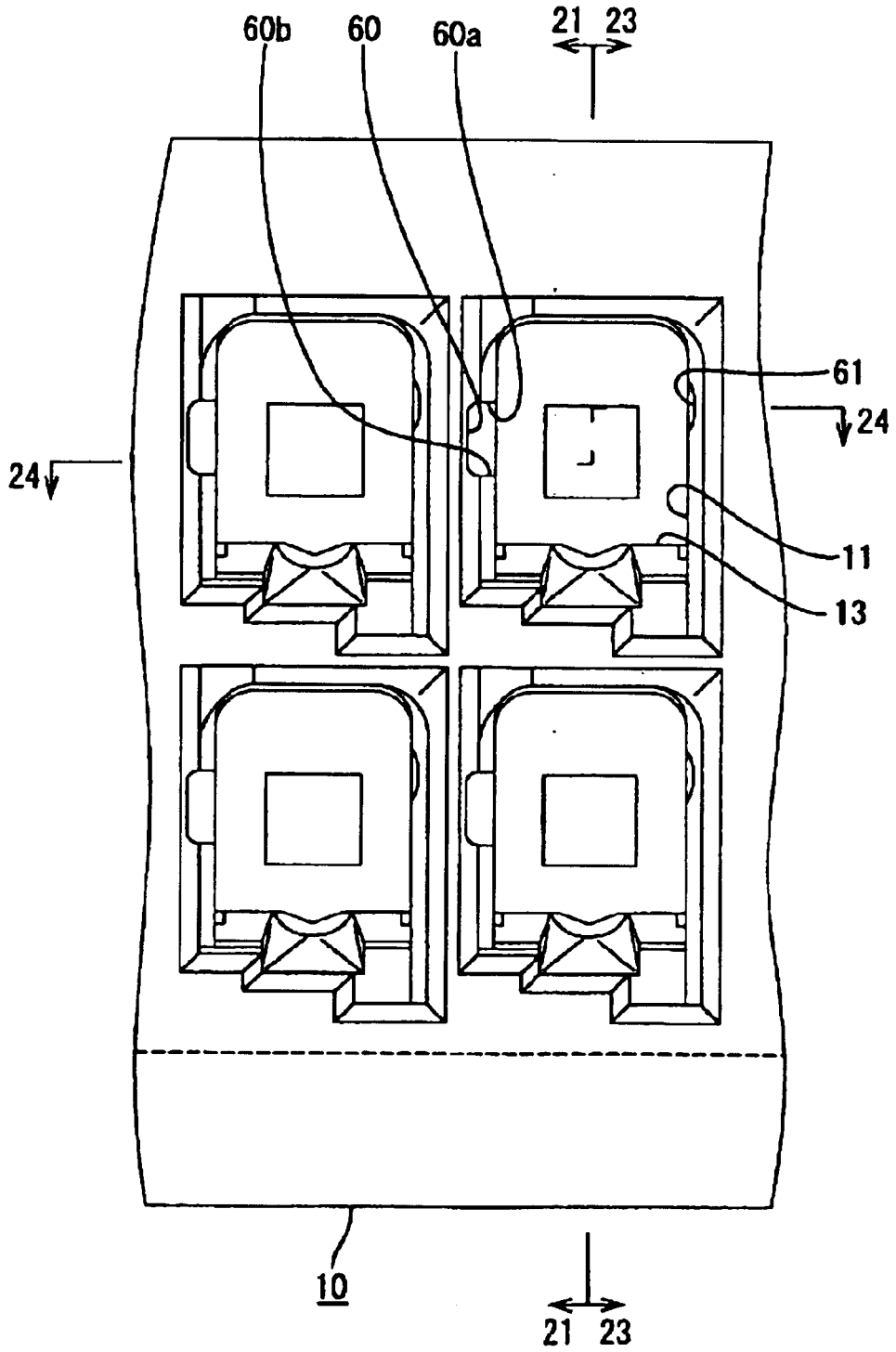
FIG. 18 is a rear view of a female housing according to a second embodiment of the invention.
Figure 21:
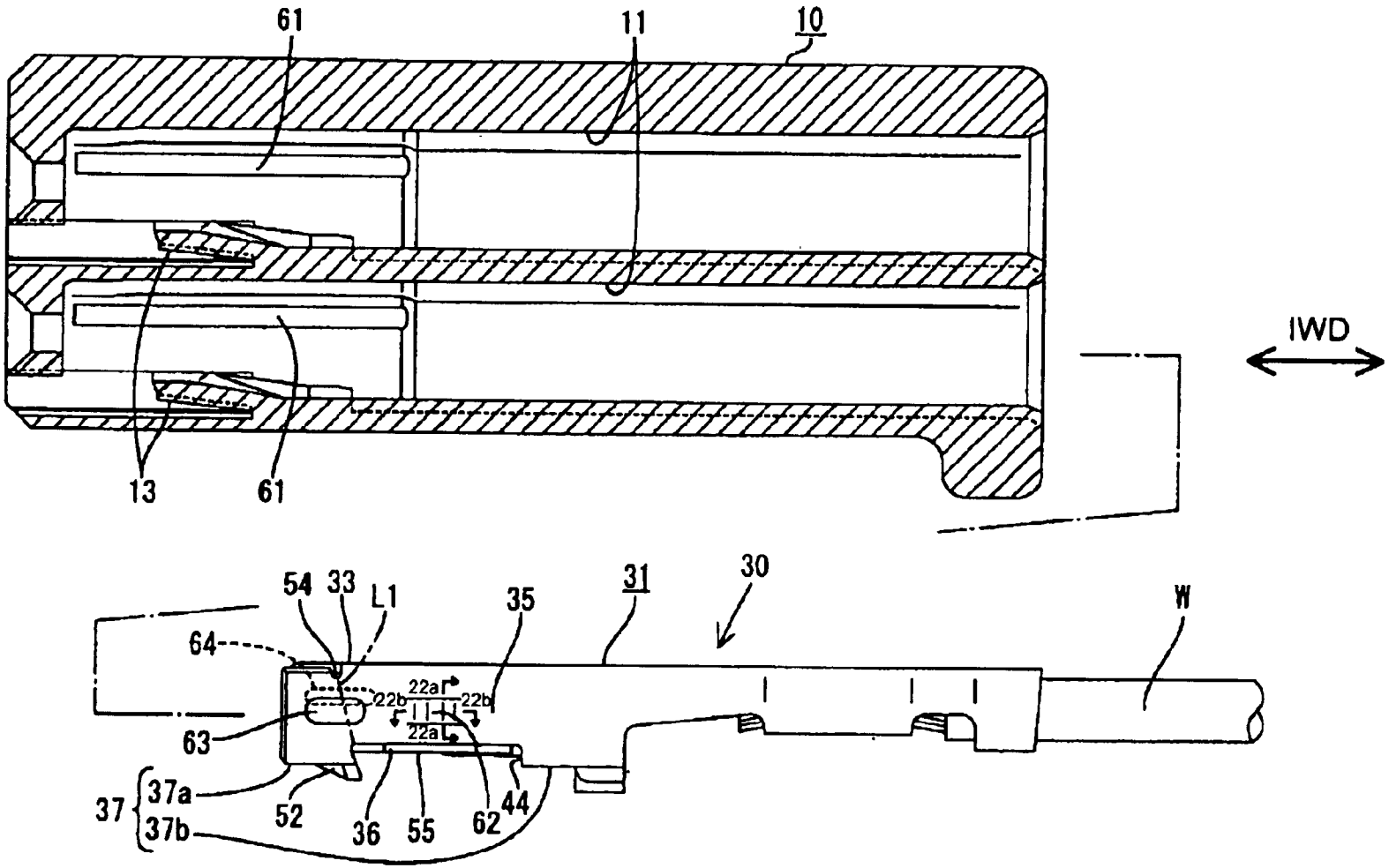
FIG. 21 is a side view in section (the female housing is shown by a section along 21—21 of FIG. 18 and the female terminal fitting is shown by a right section) showing a state before the female terminal fitting is inserted into the female housing.
Figure 22A:
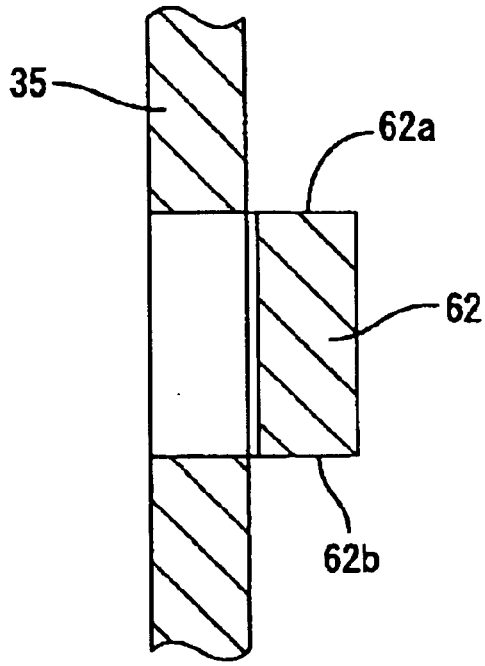
FIGS. 22(A) and 22(B) are sections of the female terminal fitting along 22A—22A and 22B—22B of FIG. 21, respectively.
Figure 22B:
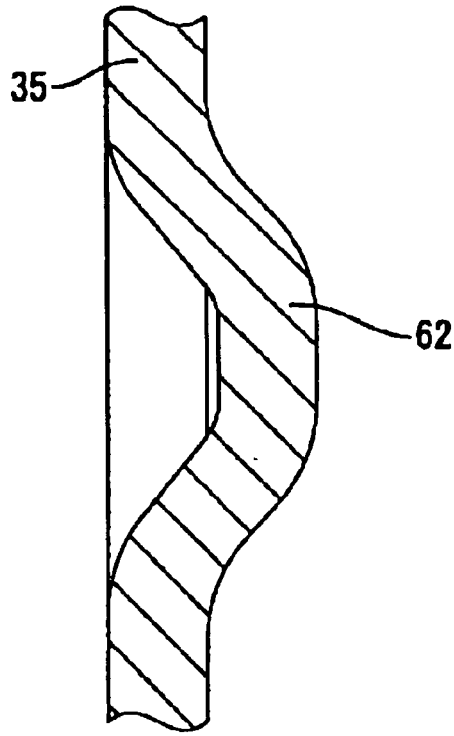
Figure 23:
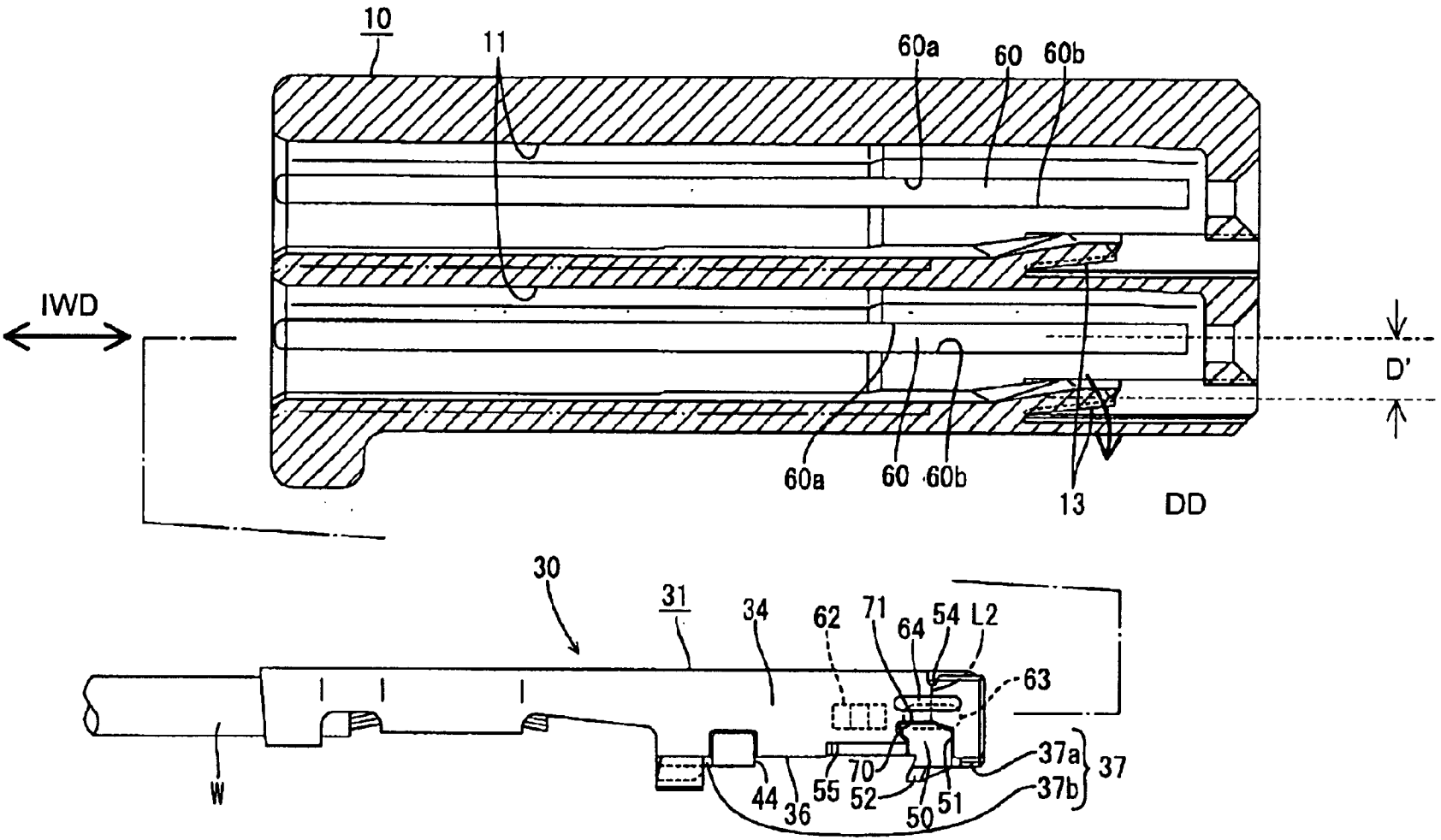
FIG. 23 is a side view in section (the female housing is shown by a section along 23—23 of FIG. 18 and the female terminal fitting is shown by a left section) showing the state before the female terminal fitting is inserted into the female housing.
Figure 24:
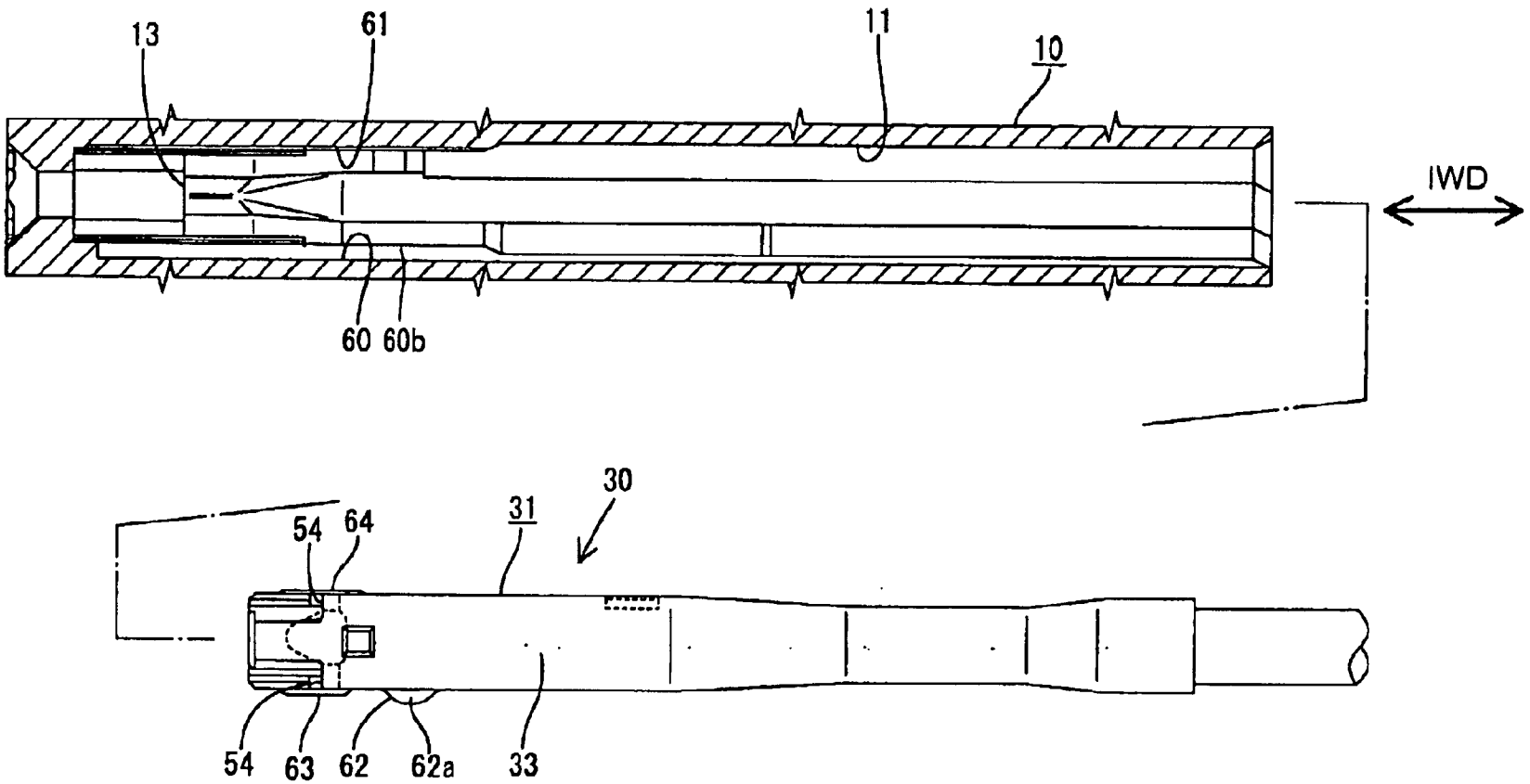
FIG. 24 is a plan view in section (the female housing is shown by a section along 24—24 of FIG. 18 and the female terminal fitting is shown by a plan view) showing the state before the female terminal fitting is inserted into the female housing.
Figure 25:
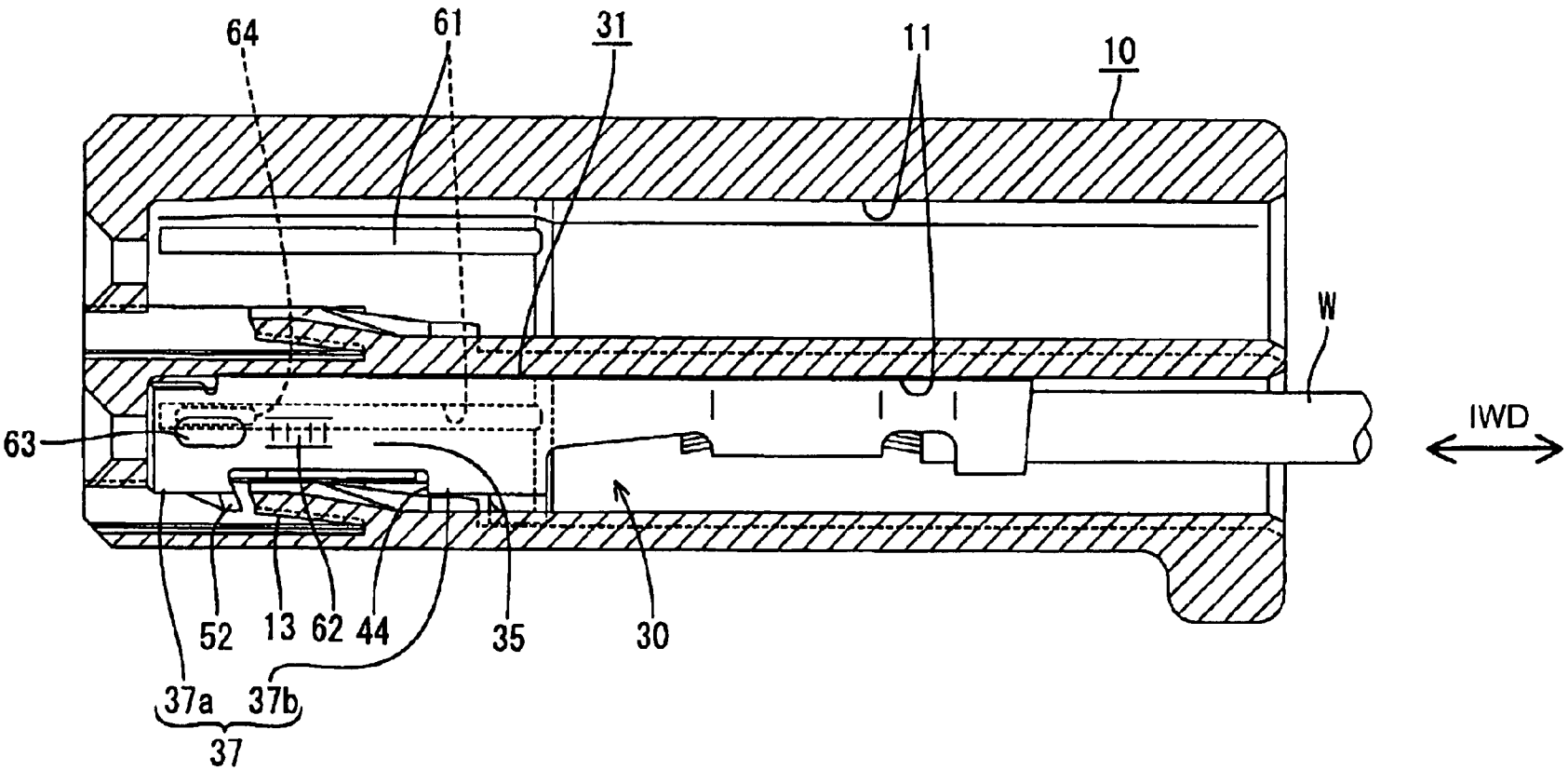
FIG. 25 is a side view in section similar to FIG. 21, but showing a state where the female terminal fitting is inserted into the female housing.
Figure 26:
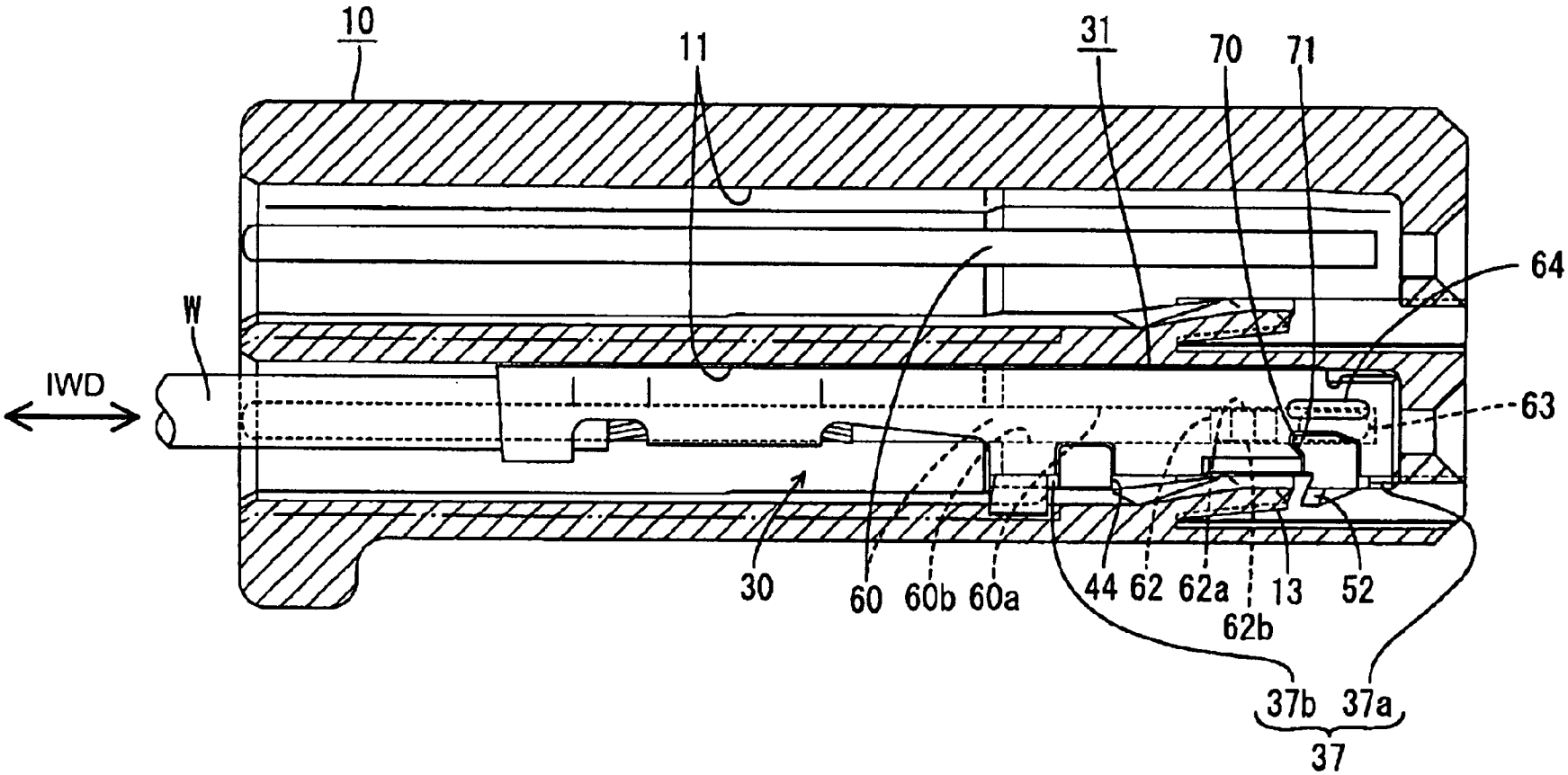
FIG. 26 is a side view in section similar to FIG. 2, but showing the state where the female terminal fitting is inserted into the female housing.
Figure 27:
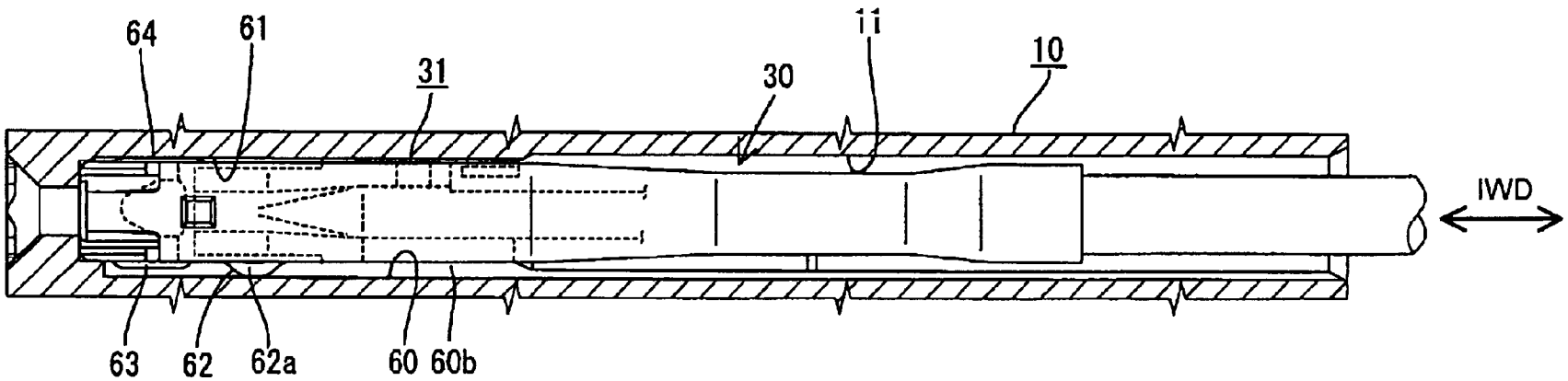
FIG. 27 is a plan view in section similar to FIG. 24, but showing the state where the female terminal fitting is inserted into the female housing.

The female housing 10 is shown in FIGS. 18, 21 and 24 and has a plurality of cavities 11. A vertical supporting groove 60 is recessed along the left inner surface of each cavity 11 and is open to the rear for receiving the supportable projection 62 and a first bead 63 of the female terminal fitting 30. This supporting groove 60 is substantially rectangular when viewed from behind, and is substantially at a middle height position of the left side surface of the cavity 11. The front end of the supporting groove 60 is slightly to the rear of the front surface of the cavity 11. Upper and lower surfaces 60*a*, 60*b* of the supporting groove 60 are formed straight along the widthwise direction, and hence are substantially normal to the deforming direction DD of the lock 13. As shown in FIGS. 18, 23 and 24, the right surface of the front half of the cavity 11 in FIG. 18 is recessed to form a rearwardly open escaping groove 61 for escaping a bead 64 of the female terminal fitting 30. This escaping groove 61 is substantially arcuate when viewed from behind and is slightly above center on the right side surface of the cavity 11. The front end of the escaping groove 61 is slightly more forward than the supporting groove 60.

The lock 13 of the second embodiment has its base end more forward than in the first embodiment and accordingly has a shorter length. Thus, the strength of the lock 13 is enhanced without changing its engaging position with the female terminal fitting 30. Further, as the lock 13 is shortened, a starting position of an upward sloped part of the upper surface of the lock 13 is slightly more backward than the base end of the lock 13.

Figure 19:
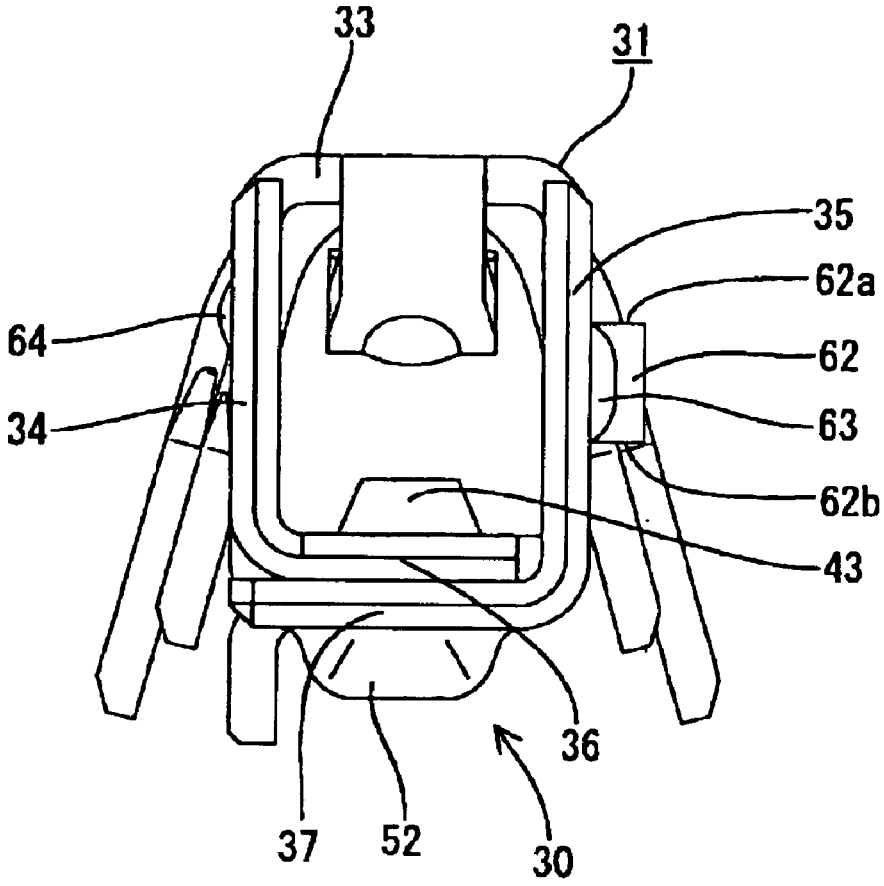
FIG. 19 is a front view of a female terminal fitting.
Figure 20:
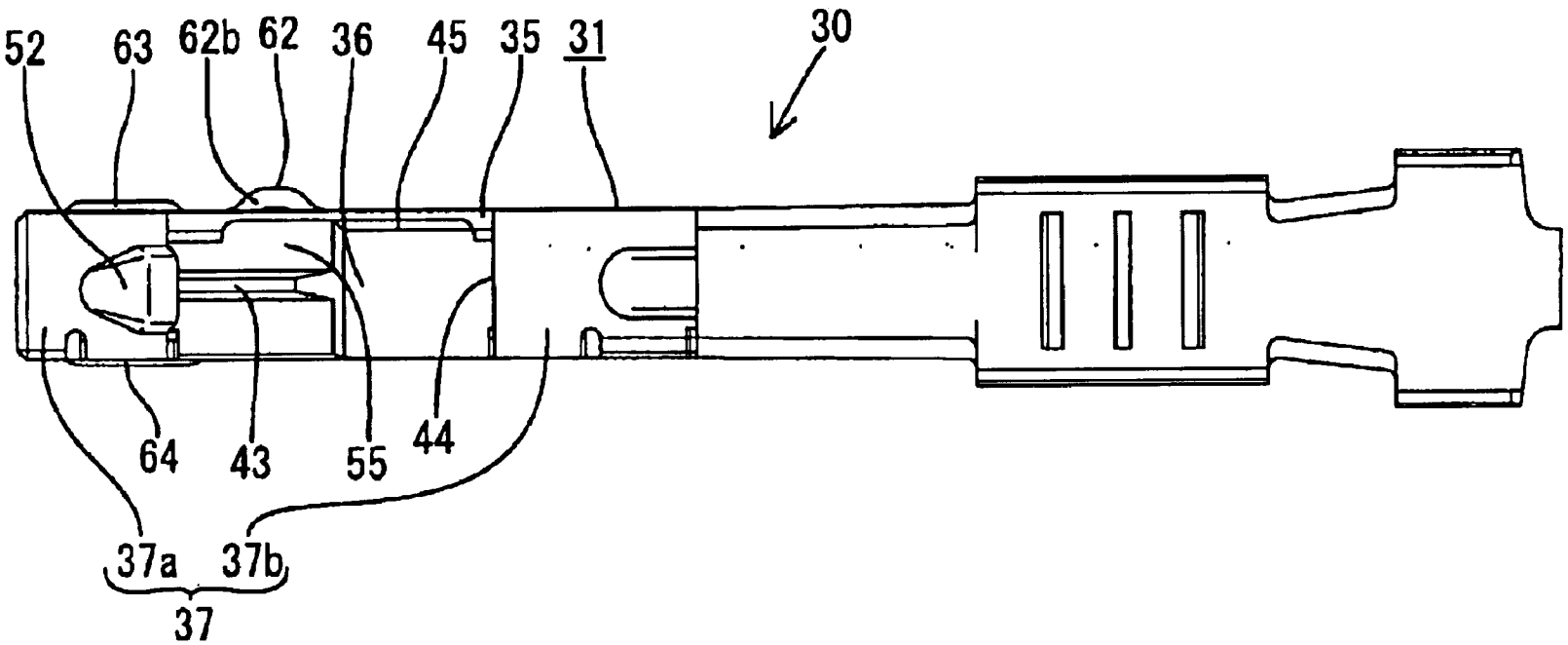
FIG. 20 is a bottom view of the female terminal fitting.

The female terminal fitting 30 of the second embodiment is shown in FIGS. 19 to 21, and has a supportable projection 62 that projects out from the right sidewall 35 of the main body 31, and fits into the supporting groove 60. The supportable projection 62 is formed by embossing a part of the sidewall 35 to project out and defines a beam coupled to the sidewall 35 at both ends. Upper and lower sides of the supportable projection 62 extend along forward and backward directions and are separated from the sidewall 35. Front and rear portions of the supportable projection 62 are inclined with respect to the sidewall 35. Thus, the front of the supportable projection 62 is slanted to the rear, and the rear end is slanted forward. Accordingly, the supportable projection 62 has a bridge-shape and is supported at the two longitudinal ends. The female terminal fitting 30 can be inserted and withdrawn smoothly into and from the cavity 11 (see FIG. 22(B)). Upper and lower surfaces 62*a*, 62*b* of the supportable projection 62 are cut end surfaces separated from the sidewall 35 and extend substantially horizontally, see FIG. 22(A). The supportable projection 62 fits into the supporting groove 60 as the female terminal fitting 30 is inserted into the cavity 11, and the upper and lower surfaces 62*a*, 62*b* of the supportable projection 62 engage the upper and lower surfaces 60*a*, 60*b* of the supporting groove 60 (see FIG. 28). The supportable projection 62 is substantially centered vertically on the sidewall 35 and slightly more forward than center with respect to forward and backward directions (but behind the locking projection 52). A vertical dimension of the supportable projection 62 is less than half, most preferably about ¼ that of the main portion 31.

An outwardly projecting first bead 63 is embossed in the right sidewall 35 of FIG. 19 at a position before the supportable projection 62 and defines an ellipse that is elongated along the inserting and withdrawing directions IWD. The first bead 63 is within the vertical range of the supportable projection 62, and projects out from the sidewall 35 less than the supportable projection 62. Thus, the first bead 63 can be inserted into the supporting groove 60 when the female terminal fitting 30 is inserted into the cavity 11. An outwardly projecting second reinforcing bead 64 is embossed in the left sidewall 34, as shown in FIGS. 19, 20 and 23, at a position above the front-portion holding groove 51 and defines an ellipse that is longer in forward and backward directions than the first bead 63. An outward-projecting height of the second bead 64 is lower than that of the first bead 63.

The sidewalls 34, 35 extend more forward than the ceiling wall 33. Thus, upwardly-opening slits 54 are formed in the sidewalls 34, 35 substantially at the same position as the front end of the ceiling wall 33 to prevent the influence of bending on the extended portions of the sidewalls 34, 35 when the sidewalls 34, 35 are bent down from the ceiling wall 33 during the formation of the female terminal fitting 30. The slits 54 reduce the strength of the sidewalls 34, 35. However, the first bead 63 is on a virtual line L1 connecting the slit 54 of the sidewall 35 and the cut-away portion 44 at a shortest distance. Similarly, the second bead 64 is substantially on a virtual line L2 connecting the slit 54 of the sidewall 34 and the front-portion holding groove 51. Thus, a reduction in the strengths of the sidewalls 34, 35 can be offset.

A restrictable projection 70 projects back from the rear end of the projecting end of the front-portion holding piece 50, and a restricting groove 71 is at the rear end of the upper end of the front-portion holding groove 51 for engagement with the restrictable projection 70. The lower surfaces of the restricting projection 70 and the restricting groove 71 are slanted and incline forward. Consequently, the lower surface of the restrictable projection 70 engages the lower surface of the restricting groove 71 when the restrictable projection 70 is fit in the restricting groove 71. Thus, a force that acts to open the front portion 37*a* of the outer wall 37 outward is resisted. The upper surfaces of the front end portions of the front-portion holding piece 5 and the front-portion holding groove 51 are inclined forward.

The front half of the bottom wall 36, including the receiving portion 43, has a recess 55 that is slightly lower than the rear half thereof. The recess 55 is formed over substantially the entire area including a portion of the bulging piece 45 that contacts the sidewall 35. The recess 55 enlarges the depth of engagement of the lock 13. The recess 55 is formed over the area extending to the upper end of the side wall 34, and the rear end surface of the front-portion holding piece 50 faces the recess 55 from the front.

The connector of this embodiment is used by initially inserting the female terminal fitting 30 into the cavity 11 from behind along the insertion and withdrawing direction IWD and in the state shown in FIGS. 21, 23 and 24. Thus, the first bead 63 and the supportable projection 62 are fit sequentially into the supporting groove 60. The second bead 64 is inserted into the escaping groove 61 after the female terminal fitting 30 is inserted up to its front half. The female terminal fitting 30 can be inserted smoothly by sliding the contact of the supportable projection 62 in contact with the inner circumferential surfaces of the supporting groove 60. The lock 13 enters the cut-away portion 44 and locks with the locking projection 52 of the front portion 37*a* of the outer wall 37 when the female terminal fitting 30 has been inserted to a proper depth. Thus, the female terminal fitting 30 is held so as not to come out, as shown in FIGS. 25 to 28.

Figure 28:
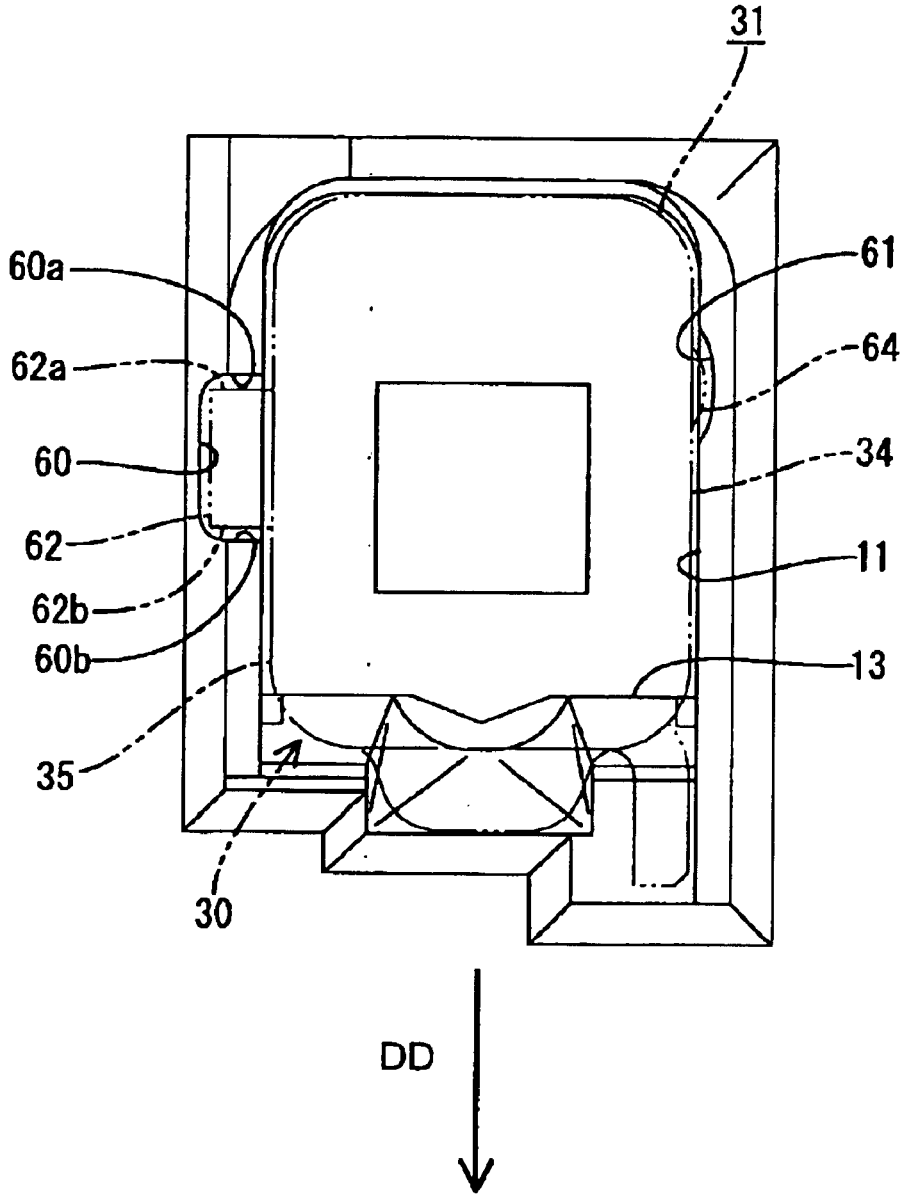
FIG. 28 is a rear view of a cavity showing the state where the female terminal fitting is inserted into the female housing.

In this proper inserted state, the supportable projection 62 is fit in the supporting groove 60 and the upper and lower surfaces 60*a*, 60*b*, 62*a*, 62*b* thereof are engaged with each other (see FIG. 28). Accordingly, even if, a pulling force acts on the wire W, the female terminal fitting 30 is prevented from vertical inclinations. Further, the upper and lower surfaces 62*a*, 62*b* of the supportable projection 62 are cut end surfaces that are separated from the side wall 35 and extend substantially horizontally along the inserting and withdrawing directions IWD. Therefore, the female terminal fitting 30 can be supported firmly without inclination. Further, if a pulling force acts on the wire W in this state, a force acts on the front portion 37*a* of the outer wall 37 engaged with the lock 13 to twist the rear end of the front portion 37*a* down with the front end thereof as a supporting point. However, the restrictable projection 70 is fit into the restricting groove 71 and the lower surfaces thereof are engaged with each other. As a result, a downward twisting opening deformation of the front portion 37*a* of the outer wall 37 can be prevented, and the main body 31 retains the rectangular tubular shape. Therefore, the female terminal fitting 30 can be locked stably by the lock 13.

As described above, the supportable projection 62 projecting from the female terminal fitting 30 fits in the supporting groove 60 in the inner side surface of the cavity 11 and extends along the deforming direction of the lock 13 when the female terminal fitting 30 is inserted into the cavity 11. Thus, the inclination of the female terminal fitting 30 in the deforming direction of the locking portion 13 can be prevented.

The supportable projection 62 is a beam supported at both ends and having the upper and lower sides separated from the sidewall 35 by embossing the sidewall 35 of the female terminal fitting 30. Consequently, a higher strength is ensured for the female terminal fitting 30 as compared to a case where the fittable groove 53 is formed by cutting out the front portion 37*a* of the outer wall 37 and the sidewall 35 as in the first embodiment (see FIG. 4). In addition, the upper and lower surfaces 62*a*, 62*b* of the supportable projection 62 to be engaged with the supporting groove 60 are the cut end surfaces that are separated from the sidewall 35 and aligned substantially normal to the deforming direction DD of the lock 13 the female terminal fitting 30 can be firmly supported and the inclination thereof can be prevented.

The first bead 63 is embossed into the sidewall 35 at the position before the supportable projection 62. Thus, the reduction in the strength of the sidewall 35 resulting from the separation of the upper and lower sides of the supportable projection 62 from the sidewall 35 can be complemented. Furthermore, the first bead 63 is within the vertical range of the supportable projection 62 in the sidewall 35. Thus, the first bead 63 is insertable into the supporting groove 60 during the insertion of the female terminal fitting 30. Thus, the construction of the female housing 10 can be simplified as compared to a case where the first bead is displaced from the width range of the supportable projection and, therefore, a special groove for permitting the insertion of the first bead needs to be formed in the inner side surface of the cavity.

Figure 29:
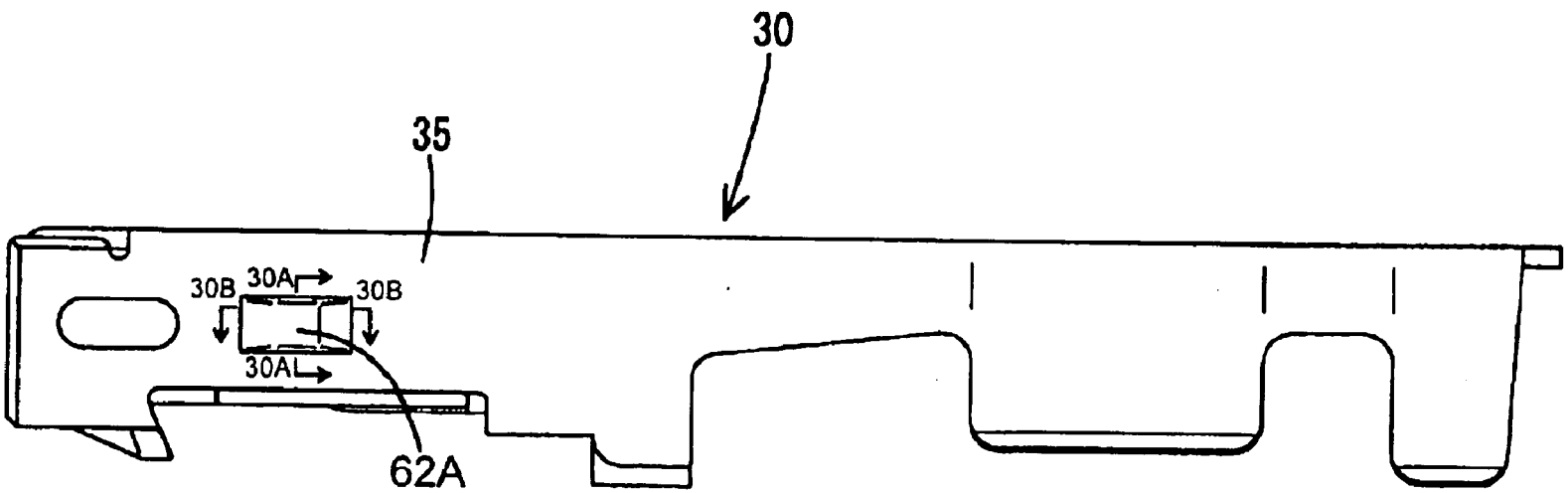
FIG. 29 is a right side view of a female terminal fitting according to a third embodiment of the invention.

A third embodiment of the invention is illustrated in FIGS. 29 and 30, and, in most respects, is identical to the second embodiment. Accordingly, parts of the third embodiment that are substantially identical to the second embodiment are identified by the same numbers, but are not described again.

Figure 30A:
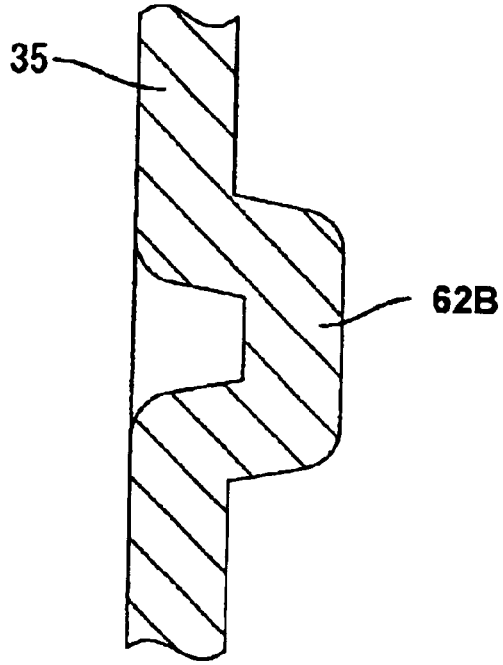
FIGS. 30(A) and 30(B) are sections of the female terminal fitting along 30A—30A and 30B—30B of FIG. 29, respectively.
Figure 30B:
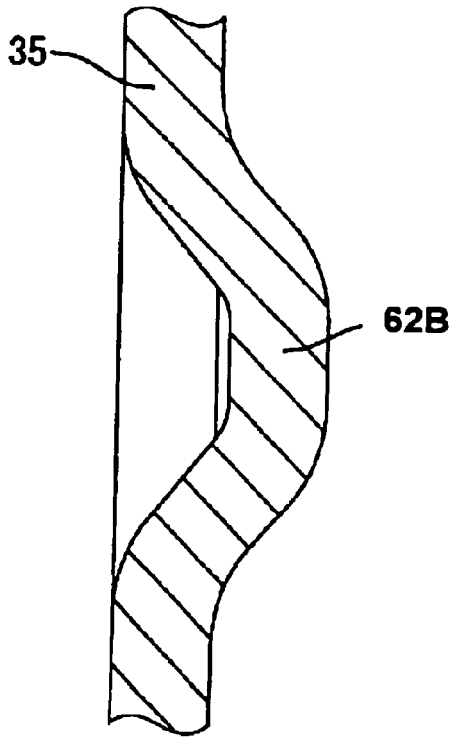

A supportable projection 62A is embossed to project out from the sidewall 35, as shown in FIG. 29, and the entire periphery of the supportable projection 62A is coupled to the sidewall 35. The supportable projection 62A is a truncated pyramid with a rectangular base that is elongated in forward and backward directions and trapezoidal cross-sections, as shown in FIGS. 30(A) and 30(B). The upper and lower surfaces of the supportable projection 62A are inclined steeper than the front and rear surfaces thereof. Although not shown, a supporting groove is formed to have a shape substantially conforming to the outer shape of the supportable projection 62A so that the supportable projection 62A can be fit into the supporting groove.

The entire periphery of the supportable projection 62A is coupled to the sidewall 35 in the third embodiment. Thus, a high strength can be ensured for the sidewall 35, as compared to the second embodiment in which the upper and lower sides of the supportable projection 62 are separated from the sidewall 35 (see FIG. 22(A)). Further, burrs are not formed by the embossment of the supportable projection 62A, and the female terminal fitting 30 is unlikely to get caught by and/or damage the inner surfaces of the cavity 11 during the insertion and withdrawal of the female terminal fitting 30. Thus, the female terminal fitting 30 can be inserted and withdrawn smoothly. Also, the female terminal fitting 30 is unlikely to get caught by the mold used to emboss the supportable projection 62A because no burr is formed. Therefore, no mechanism is necessary to disengage the caught female terminal fitting 30. Accordingly, installations are simpler and the production is easier.

Figure 31:
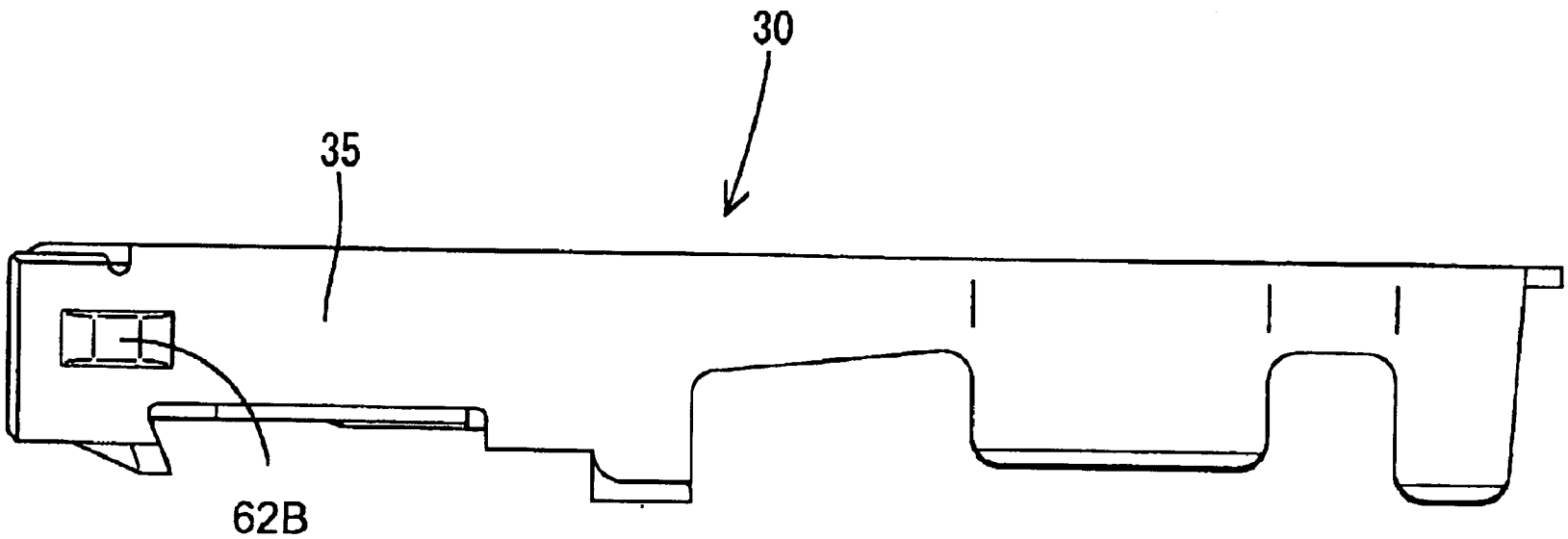
FIG. 31 is a right side view of a female terminal fitting according to a modification of the third embodiment of the invention.
Figure 32:
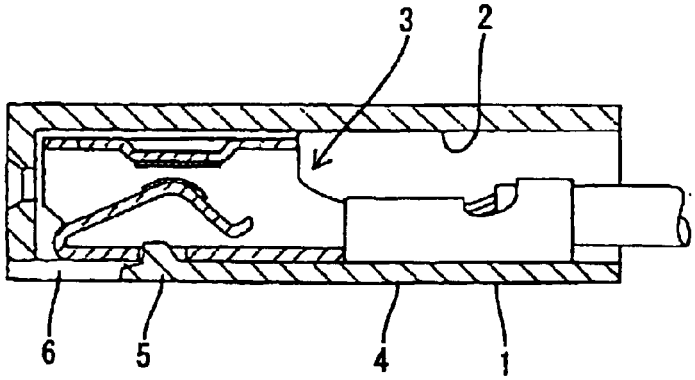
FIG. 32 PRIOR ART
FIG. 32 is a section of a prior art connector.
Figure 33:
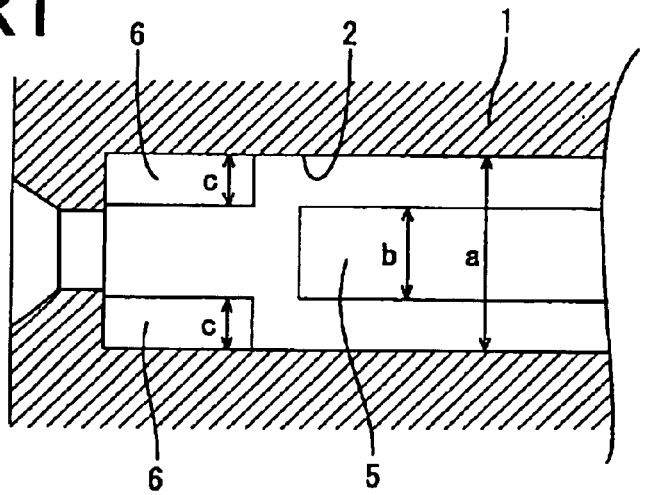
FIG. 33 PRIOR ART
FIG. 33 is a section of the prior art connector.

As a modification of the third embodiment, the first bead 63 (see FIG. 29) is omitted and a supportable projection 62B may be provided instead as shown in FIG. 31. The entire periphery of the supportable projection 62B is coupled to the sidewall 35. Therefore, the supportable projection 62B has the same reinforcing function as the first bead 63. Hence, the construction of the female terminal fitting 30 can be simplified while the strength of the sidewall 35 is maintained at the same level as in the second embodiment.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The supporting projection is provided in the cavity and the fittable groove is formed in the female terminal fitting in the foregoing embodiment. However, a supporting recess may be formed in the front surface of the cavity, and a supportable projection may project forward from the front end of the female terminal fitting. The supportable projection then may be fit into the supporting recess as the female terminal fitting is inserted into the cavity.

Although the female connector is described and illustrated in the foregoing embodiments, the invention is also applicable to male connectors.

The supportable projection is supported at both ends in the second embodiment. However, a supportable projection cut and bent from the sidewall and supported only at one end is also embraced by the invention.

The female housing is resin-molded by front and rear molds in the foregoing embodiments. However, the female housing may be resin-molded using slidable molds that close and open along vertical or widthwise directions in addition to the front and rear molds also is embraced by the invention.

The supporting groove of the second and third embodiments could be at a position of the side surface of the cavity facing the side of the lock (located within a thickness range of the lock).

What is claimed is:

1. A connector comprising a housing having at least one cavity with opposite top and bottom surfaces and opposite side surfaces extending between the top and bottom surfaces and a terminal fitting insertable into the cavity along an insertion direction, the terminal fitting having opposite top and bottom walls and opposite side walls for substantially slidable engagement with the respective top and bottom surfaces and side surfaces of the cavity, a resiliently deformable lock projecting into the cavity from one of the top and bottom surfaces of the cavity, the lock being deformable in a deformation direction in response to forces generated during insertion of the terminal fitting into the cavity, the deformation direction intersecting the insertion direction, the lock being resiliently restored after insertion of the terminal fitting for locking the terminal fitting in the cavity, wherein the terminal fitting comprises a supportable portion projecting outwardly from one of the side walls of the terminal fitting, and wherein the cavity comprises a supporting groove in one of said side surfaces for engaging and supporting the supportable portion and preventing inclination of the terminal fitting relative to the lock, the supporting groove being spaced from the lock along the deformation direction of the lock.

2. The connector of claim 1, wherein the supportable portion is an embossment in a sidewall of the terminal fitting so as to be continuous with the sidewall over the entire circumference of the supportable projection.

3. The connector of claim 2, further comprising a bead embossed in the sidewall for reinforcing the terminal fitting.

4. The connector of claim 3, wherein the bead is within a range of the supportable projection that extends along the deforming direction of the lock.

5. The connector of claim 1, wherein one of the top and bottom walls of the terminal fitting include a cut-away portion defining a front cut end surface, a locking projection being formed adjacent the front cut end surface, the lock of the housing being configured for engaging both the front cut end surface and the locking projection for locking the terminal fitting in the cavity.

6. A terminal fitting for insertion into a cavity in a housing of a connector along an inserting direction, a resiliently deformable lock provided in the cavity and being resiliently deformable in a deformation direction that intersects the inserting direction of the terminal fitting, the lock being configured for locking the terminal fitting in the cavity, wherein the terminal fitting comprises opposed top and bottom walls and opposed side walls extending between the top and bottom walls, one of the top and bottom walls being formed with a cut-away portion defining a front locking edge for locked engagement with the resiliently deformable lock of the housing, a supportable portion embossed to project outwardly on one of said side walls, said supportable portion being disposed and configured for engaging a supporting groove in a corresponding side surface of the cavity so that the terminal fitting is supported by the supporting portion for preventing inclination of the terminal fitting with respect to the lock during the insertion.

7. The terminal fitting of claim 6, wherein a locking projection is formed adjacent the front locking edge, the lock of the housing being configured for engaging both the front locking edge and the locking projection for locking the terminal fitting in the cavity.

8. A terminal fitting for insertion into a cavity in a housing of a connector along an inserting direction, a resiliently deformable lock provided in the cavity and being resiliently deformable in a deformation direction that intersects the inserting direction of the terminal fitting, wherein;

the terminal fitting comprises a substantially rectangular tubular main body having opposite front and rear ends, opposed top and bottom walls and opposed sidewalls extending between the top and bottom walls, the bottom wall being formed with a cut-away at a location spaced from both the front and rear ends of the tubular main body, a locking projection being formed on the bottom wall forward of and adjacent to the cut-away such that the locking projection includes a rearwardly facing edge and such that portions of the main body on opposite sides of the locking projection and adjacent the cut-away define rearwardly facing cut end surfaces, one of said side walls being formed with a supportable portion, whereby the lock of the housing is engageable with both the locking projection and the cut end surfaces adjacent the cut-away and whereby the supportable portion is engageable in a supporting groove of the cavity for preventing inclination of the terminal fitting with respect to the lock during insertion of the terminal fitting into the cavity.

* * * * *